US008757764B2

(12) United States Patent
Ishii et al.

(10) Patent No.: US 8,757,764 B2
(45) Date of Patent: Jun. 24, 2014

(54) LIQUID EJECTING HEAD UNIT AND LIQUID EJECTING APPARATUS

(75) Inventors: Hiroyuki Ishii, Shiojiri (JP); Hiroyuki Hagiwara, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/330,577

(22) Filed: Dec. 19, 2011

(65) Prior Publication Data

US 2012/0182348 A1 Jul. 19, 2012

(30) Foreign Application Priority Data

Jan. 14, 2011 (JP) ..... 2011-006493

(51) Int. Cl.
*B41J 2/015* (2006.01)

(52) U.S. Cl.
USPC ..... 347/20

(58) Field of Classification Search
None
See application file for complete search history.

(56) References Cited

U.S. PATENT DOCUMENTS

| | | | | |
|---|---|---|---|---|
| 6,575,557 | B2 * | 6/2003 | Tominaga | 347/37 |
| 7,322,394 | B2 * | 1/2008 | Nakamura et al. | 156/356 |
| 8,075,080 | B2 * | 12/2011 | Albertalli et al. | 347/19 |
| 8,191,991 | B2 * | 6/2012 | Hagiwara et al. | 347/40 |
| 2003/0085943 | A1 | 5/2003 | Nakamura et al. | |
| 2010/0188461 | A1 * | 7/2010 | Hagiwara et al. | 347/44 |
| 2010/0295896 | A1 * | 11/2010 | Albertalli et al. | 347/37 |

FOREIGN PATENT DOCUMENTS

JP 2007-090327 A 4/2007

* cited by examiner

*Primary Examiner* — Geoffrey Mruk
*Assistant Examiner* — Bradley Thies
(74) *Attorney, Agent, or Firm* — Kilpatrick Townsend & Stockton LLP

(57) ABSTRACT

A recording head which ejects ink and a sub carriage, which has a head insertion opening where the recording head is inserted and the recording head is fixed to an opening edge portion of the head insertion opening, are provided and a box beam section is provided in the opening edge portion. The box beam section is configured from a first wall section which has a side surface which faces the head insertion opening, a second wall section which is positioned further to the outside than the first wall section and opposes the first wall section, and a third wall section which connects the first wall section and the second wall section.

14 Claims, 19 Drawing Sheets

LIQUID EJECTING HEAD UNIT AND LIQUID EJECTING APPARATUS

The entire disclosure of Japanese Patent Application No: 2011-006493, filed Jan. 14, 2011 is expressly incorporated by reference herein.

BACKGROUND

1. Technical Field

The present invention relates to a liquid ejecting head unit and a liquid ejecting apparatus, and in particular relates to an ink jet recording head unit and an ink jet recording apparatus which discharges ink as a liquid.

2. Related Art

A liquid ejecting apparatus is an apparatus which is provided with a liquid ejecting head, which is able to eject a liquid as droplets, and ejects various types of liquid from the liquid ejecting head. As a representative of the liquid ejecting apparatus, for example, an image recording apparatus such as an ink jet recording apparatus (printer), which is provided with an ink jet recording head (referred to below as a recording head) and performs recording by ejecting ink in liquid form as ink droplets from a nozzle of a recording head, can be given as an example. In addition, in recent years, without being limited to the image recording apparatus, the liquid ejecting apparatus has been applied also to various types of manufacturing apparatuses such as a display manufacturing apparatus. Then, ink in liquid form is ejected by the recording head of the image recording apparatus, and a solution of various colorants of R (Red), G (Green), and B (Blue) are ejected by a colorant ejecting head in the display manufacturing device. In addition, an electrode material in liquid form is ejected by an electrode material ejecting head in an electrode forming device and a solution of a bioorganic compound is ejected by a bioorganic compound ejecting head in a chip manufacturing device.

In recent years, a configuration has been adopted in the printer described above where one head unit is set as the recording heads (multi-head type), which has a nozzle row formed of a plurality of nozzles which are lined up, being lined up in plurality and fixed to a head fixing member such as a sub carriage. Then, in the configuration where each of the recording heads is screwed into place in a state of having been positioned with regard to the sub carriage, after having been positioned and before screwing, temporary fixing of the recording head is performed using an adhesive agent (for example, instantaneous adhesive agent) with regard to the sub carriage. Due to this, deviation of the position of the recording head due to rotation moment when screwing is prevented when permanently fixing by screwing. In a case where temporary fixing using the adhesive agent in this manner is adopted, it is difficult to remove the recording head which has been fixed once to the sub carriage for repairs or replacement. With regard to a problem such as this, a configuration is proposed where an intermediate member which is referred to as a spacer is interposed between the recording head and the sub carriage (for example, JP-A-2007-90327). According to the configuration, by the spacer being fixed in advance by screwing to the recording head and the spacer and the sub carriage being permanently fixed by screwing after temporary fixing using the adhesive agent between the spacer and the sub carriage, the recording head which is fixed once to the sub carriage is able to be removed from the spacer and the sub carriage by releasing the fastening of the screws between the spacer and the recording head. Due to this, attaching and detaching of the recording head due to replacement or repairing of the recording head is easy.

In a case where the sub carriage is fixed to other parts, external force from the parts is applied to the sub carriage. The sub carriage may be easily deformed when rigidity is low and the position of the recording head with regard to the sub carriage may deviate. In addition, the sub carriage may be deformed when rigidity is low and the initial position of the recording head may deviate not only due to such external forces but also due to creep load or changes in the atmosphere (changes in temperature and humidity and the like). When there is positional deviation of the recording head, the impact accuracy of the ink is reduced. As a result, it is preferable that the sub carriage where the recording head is fixed via the spacer has high rigidity.

Here, this problem exists in the same manner also in ink jet recording heads which are provided with a recording head which is directly fixed to the sub carriage without a spacer. In addition, this problem exists not only in the ink jet recording heads which eject ink droplets but also in the liquid ejecting heads which eject other droplets.

SUMMARY

An advantage of some aspects of the invention is that a liquid ejecting head unit and a liquid ejecting apparatus, which improve the rigidity of a head fixing member and prevent positional deviation of the liquid ejecting head, are provided.

According to an aspect of the invention, there is provided a liquid ejecting head unit including a liquid ejecting head, which has a nozzle which ejects liquid, and a head fixing member which has an opening where the liquid ejecting head is inserted and in which the liquid ejecting head is fixed to an opening edge portion of the opening, where a box beam section is provided in the opening edge portion.

In this configuration, the head fixing member has high rigidity since the box beam section is provided in the head fixing member where the liquid ejecting head is fixed. Accordingly, deforming of the head fixing member for various reasons is prevented. By preventing the deforming of the head fixing member, there is no positional deviation of the liquid ejecting head, which is fixed to the head fixing member in a state of being disposed in a regulation position, from the regulation position, and a reduction in the impact accuracy of the liquid is prevented.

Here, it is preferable that a through hole, which passes through an inner portion of the box beam section and opens to a nozzle side of the liquid ejecting head, be provided in the head fixing member and the liquid ejecting head is fastened to the head fixing member using a fastening member which is inserted in the through hole.

For example, in the liquid ejecting head, an electric section such as a connector, where a flexible cable or the like which transmits a drive signal or the like to the liquid ejecting head is connected, is provided on a side which is opposite to one surface where a nozzle row is provided. In the liquid ejecting head unit where the liquid ejecting head is fixed to the sub carriage in this manner, while the nozzle row is exposed to the outside, the connector side is covered by a cover member or the like and the entry of ink droplets into the connector or the like from the outside is prevented.

However, one edge portion of a screw which fixes a spacer to the sub carriage is positioned in a space on an inner side which is covered by the cover member, and there is a concern that ink may enter the connector or the like by being transferred to the surface of the screw when the other edge portion of the screw is exposed to the outside of the nozzle row side. Due to ink such as this, there is a concern that the electric section of the liquid ejecting head may short out, an erroneous operation may occur, and electronic parts may break down.

Therefor, by providing the through hole, where the fastening member which fixes the liquid ejecting head to the head fixing member is inserted, in an inner portion of the box beam section, liquid which enters along the surface of the fastening member is retained at an inner portion of the box beam section. Due to this, the liquid ejecting head unit is provided where the liquid is prevented from reaching the electric section of the liquid ejecting head and reliability is improved.

In addition, it is preferable that a through hole, which passes through an inner portion of the box beam section and opens to a nozzle side of the liquid ejecting head, be provided in the head fixing member, an intermediate member which is interposed between the liquid ejecting head and the head fixing member be attached in the liquid ejecting head, and the intermediate member be fastened to the head fixing member by a fastening member which is inserted in the through hole. Due to this, attaching and detaching of the liquid ejecting head due to replacement or repairing of the liquid ejecting head is easy.

In addition, it is preferable that the head fixing member be provided with a base section with a plate shape which is provided with the opening and the box beam section be configured from a first wall section which has a side surface which faces the opening and is erected in the base section, a second wall section which is positioned further to the outside than the first wall section and is erected in the base section so as to oppose the first wall section, and a third wall section which is erected in the base section so as to connect the first wall section and the second wall section. Due to this, it is possible to appropriately configure the box beam section.

In addition, it is preferable that the liquid ejecting head has a nozzle row where a plurality of nozzles are arranged in a line and both edge portions in an arrangement direction of the nozzle row be fixed to the opening edge portion of the head fixing member and the box beam section be provided in a region where both edge portions of the head fixing member are fixed. Due to this, the positional deviation of the liquid ejecting head, which is fixed to the head fixing member in a state of being disposed in a regulation position, is more reliability prevented.

In addition, according to another aspect of the invention, there is provided a liquid ejecting apparatus where the liquid ejecting head unit is mounted. In this configuration, the liquid ejecting apparatus, where positional deviation of the liquid ejecting head is prevented by improving the rigidity of the head fixing member and reliability is improved by protecting the electric section from the entry of liquid, is provided.

BRIEF DESCRIPTION OF THE DRAWINGS

The invention will be described with reference to the accompanying drawings, wherein like numbers reference like elements.

DESCRIPTION OF EXEMPLARY EMBODIMENTS

Below, an embodiment for realizing the invention will be described with reference to the attached diagram. Here, in the embodiment which is described below, there are various limitations as an appropriate specific example of the invention, but the scope of the invention is not limited by the embodiment unless it is described that the invention is particularly limited in the description below. In addition, below, an ink jet recording apparatus (below, a printer) will be described as an example as the liquid ejecting apparatus of the invention.

Figure 1:
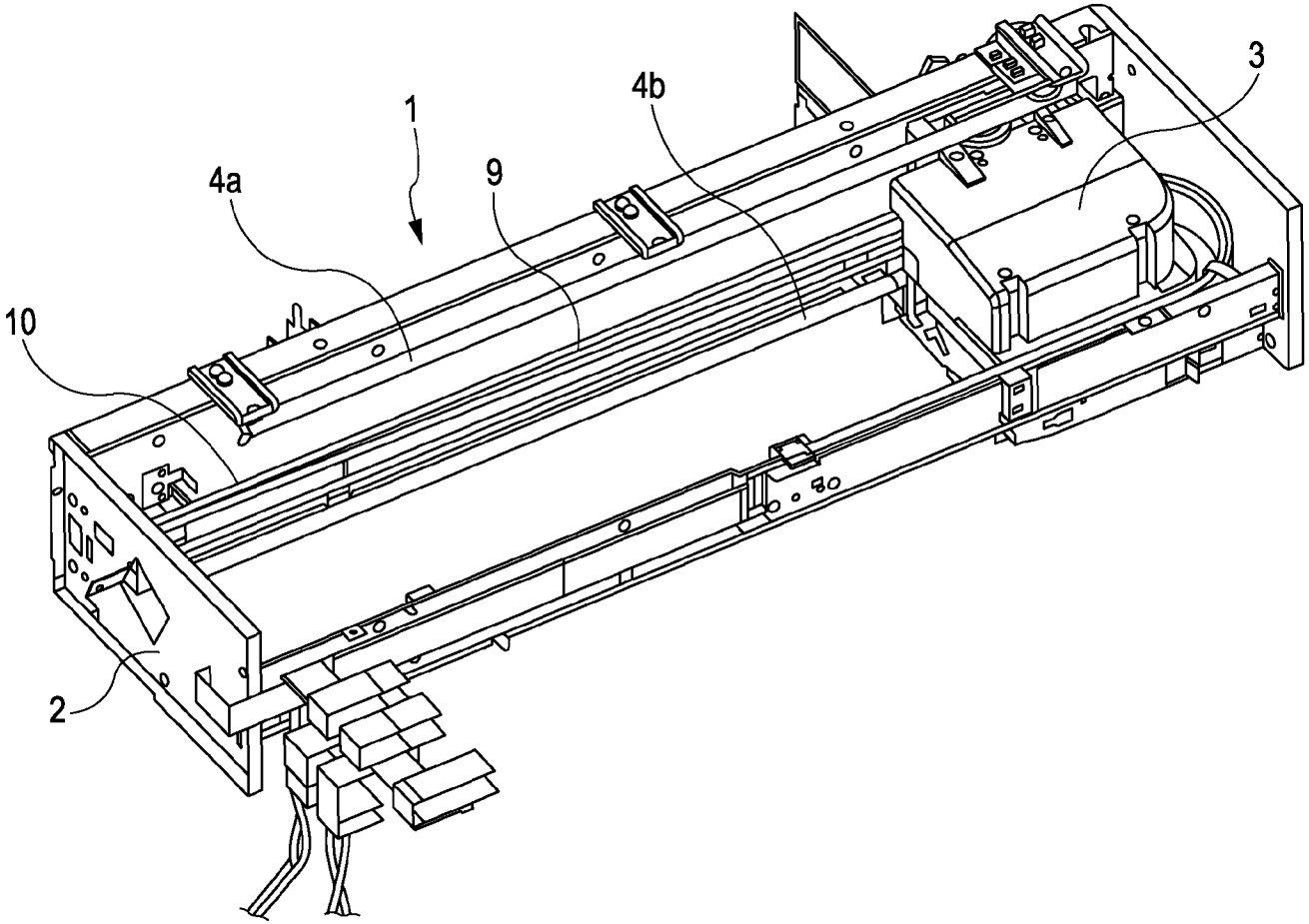
FIG. 1 is a perspective diagram illustrating one portion of an inner configuration of a printer.
Figure 2:
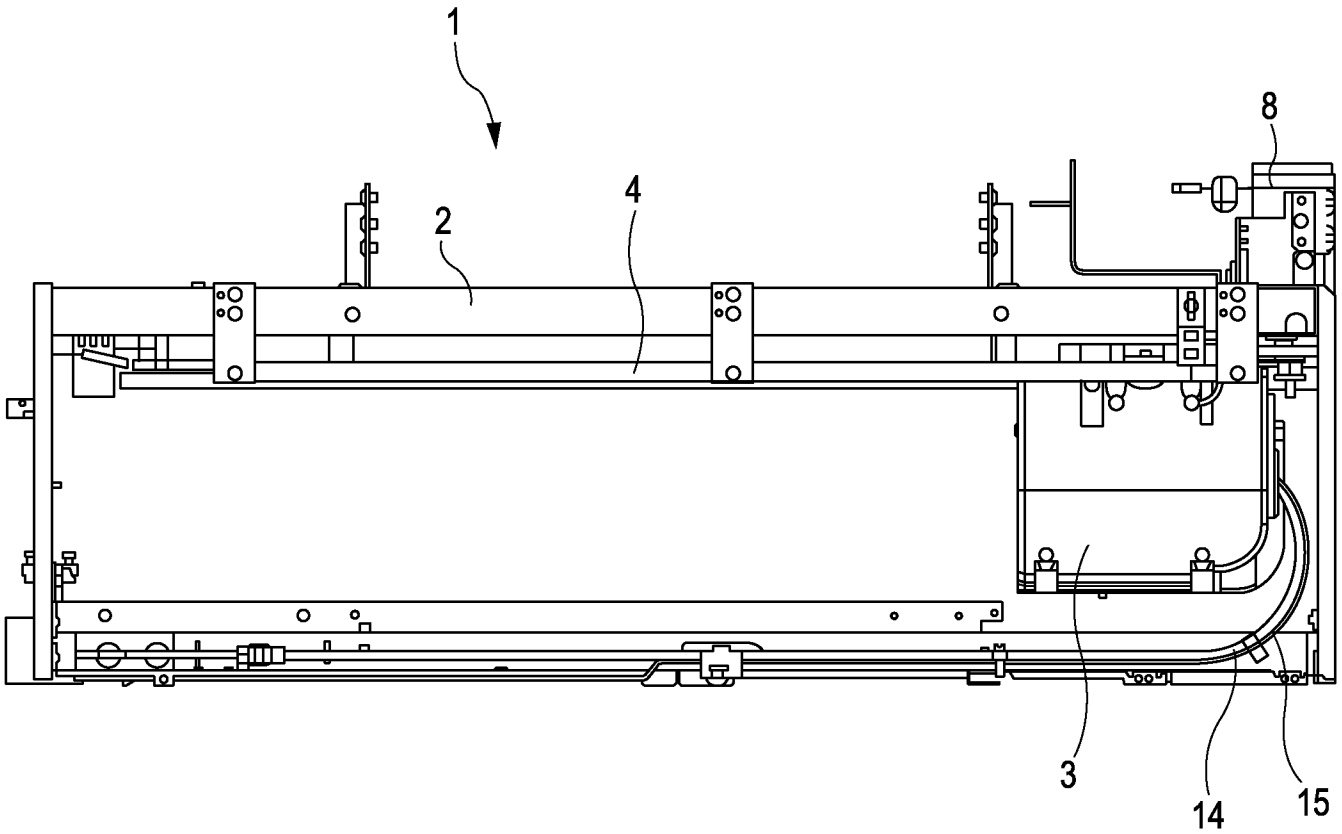
FIG. 2 is a planar diagram illustrating one portion of an inner configuration of a printer.

FIG. 1 is a perspective diagram illustrating one portion of an inner configuration of a printer 1, and FIG. 2 is a planar diagram illustrating one portion of an inner configuration of the printer 1. The printer 1 which is shown ejects ink which is one type of liquid toward a recording medium (impact target) such as recording paper, cloth, or film. In the printer 1, a carriage 3 (one type of head unit holding member) is mounted at an inner portion of a frame 2 so as to be able to move and reciprocate in a main scanning direction which is a direction which intersects with the transmitting direction of the recording medium. In an inner wall of the frame 2 at a rear surface side of the printer 1, a pair of upper and lower guide rods 4*a* and 4*b* with long lengths are attached in parallel with a gap opened out from each other along a longitudinal direction of the frame 2. The carriage 3 is supported to be able to slide with regard to the guide rods 4*a* and 4*b* by a shaft reception section 7 (refer to FIG. 4) which is provided on a rear surface side thereof or the like being engaged with the guide rods 4*a* and 4*b*.

In one edge side of the main scanning direction on the rear surface side of the frame 2 (right edge portion in FIG. 2), a carriage motor 8 is disposed as a driving source for moving the carriage 3. The drive shaft of the carriage motor 8 protrudes from a rear surface side to an inner surface side of the frame 2, and a drive pulley (not shown) is connected to a front edge portion thereof. The drive pulley rotates due to the driving of the carriage motor 8. In addition, a idling pulley (not shown) is provided at a position on an opposite side in the main scanning direction with regard to the drive pulley (left edge portion in FIG. 2). A timing belt 9 spans between these pulleys. The carriage 3 is connected to the timing belt 9. Then, when the carriage motor 8 is driven, the timing belt 9 rotates in accompaniment with the rotation of the driving pulley and the carriage 3 moves in the main scanning direction along the guide rods 4*a* and 4*b*.

A linear scale 10 (encoder film) is spread out in parallel with the guide rods 4*a* and 4*b* along the main scanning direction at an inner wall on the rear surface of the frame 2. The linear scale 10 is a band shaped member which is manufactured using a transparent resin film, and for example, a non-transparent stripe which traverses in the band width direction is printed a plurality of time on a surface of a transparent base film. Each of the stripes has the same width and is formed at a constant pitch in the band length direction. In addition, a linear encoder (not shown) is provided in a rear surface side of the carriage 3 in order to optically read the stripes of the linear scale 10. The linear encoder is one type of position information outputting means and an encoder pulse according to the scanning position of the carriage 3 is output as position information in the main scanning direction. Due to this, a control section (not shown) of the printer is able to control a recording operation with regard to the recording medium using a head unit 17 (refer to FIG. 3) while confirming the scanning position of the carriage 3 based on the encoder pulse. Then, the printer 1 is configured so that a so-called bi-directional recording process where text, images, or the like are recorded on recording paper is possible in two directions during outward movement when the carriage 3 moves from a home position at one edge end in the main scanning direction toward the edge portion of the opposite side (full position) and during return movement when the carriage 3 returns from the full position to the home position side.

As shown in FIG. 2, an ink supply tube 14 for supplying each color of ink to each recording head 18 in the head unit 17 and a signal cable 15 for supplying a signal such as a drive signal are connected in the carriage 3. Other than this, although not shown, a cartridge mounting section where ink cartridges (liquid supply sources) in which ink is retained are mounted so as to be able to be attached and detached, a transport section which transports the recording paper, a capping section which caps a nozzle forming surface 53 (refer to FIG. 12) of the recording head 18 in a waiting state, and the like are provided in the printer 1.

Figure 3:
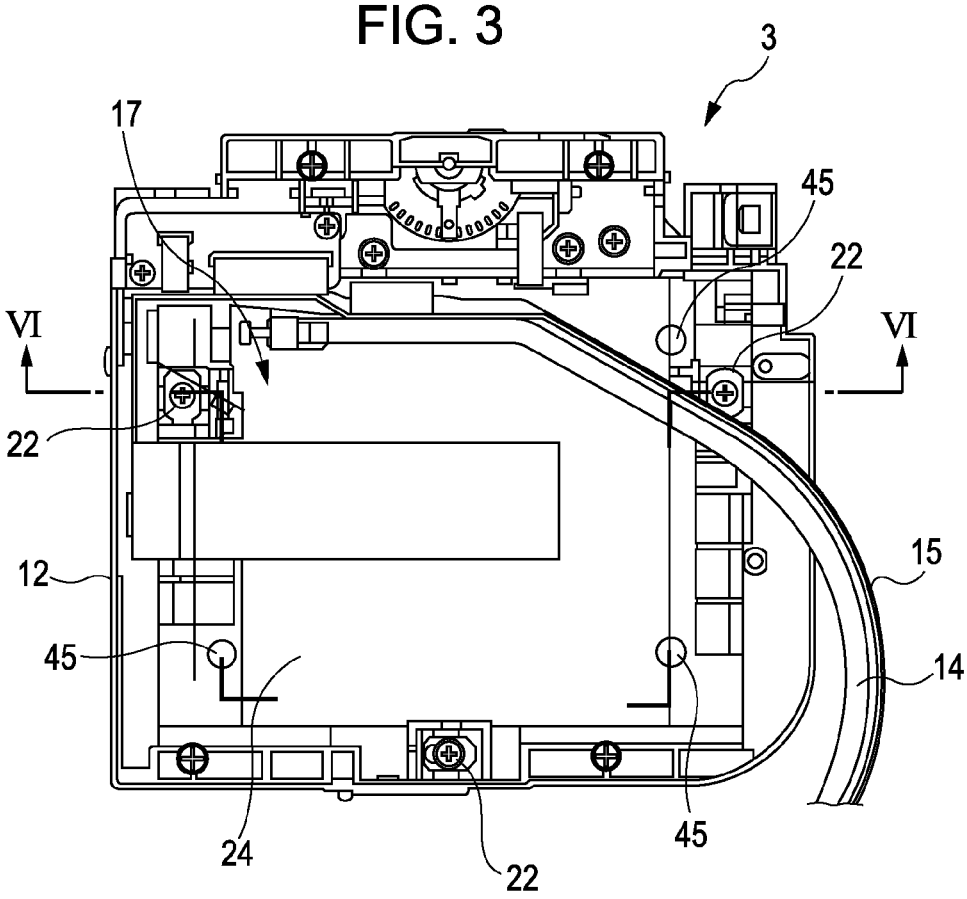
FIG. 3 is an upper surface view of a carriage.
Figure 4:
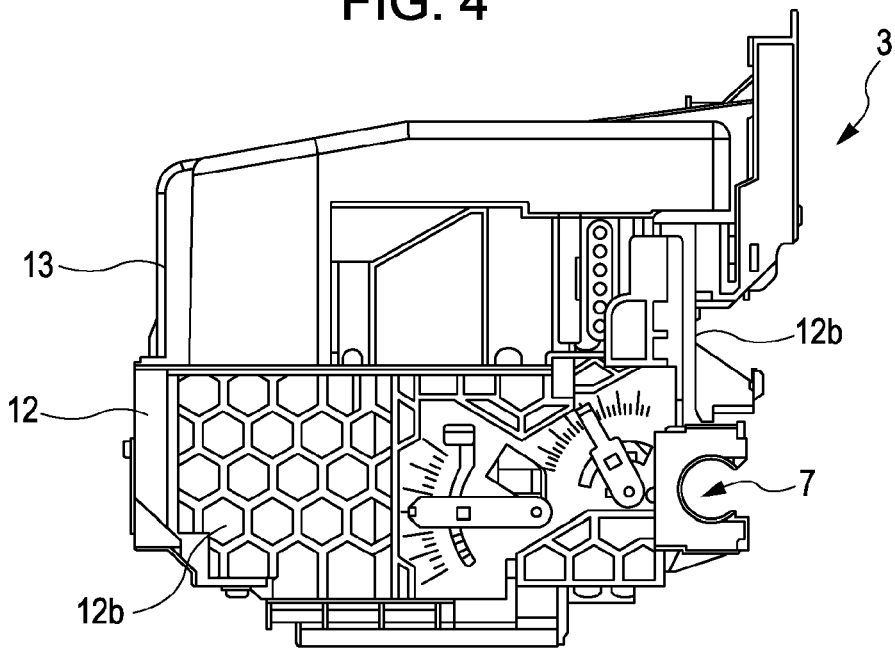
FIG. 4 is a right side surface view of a carriage.
Figure 5:
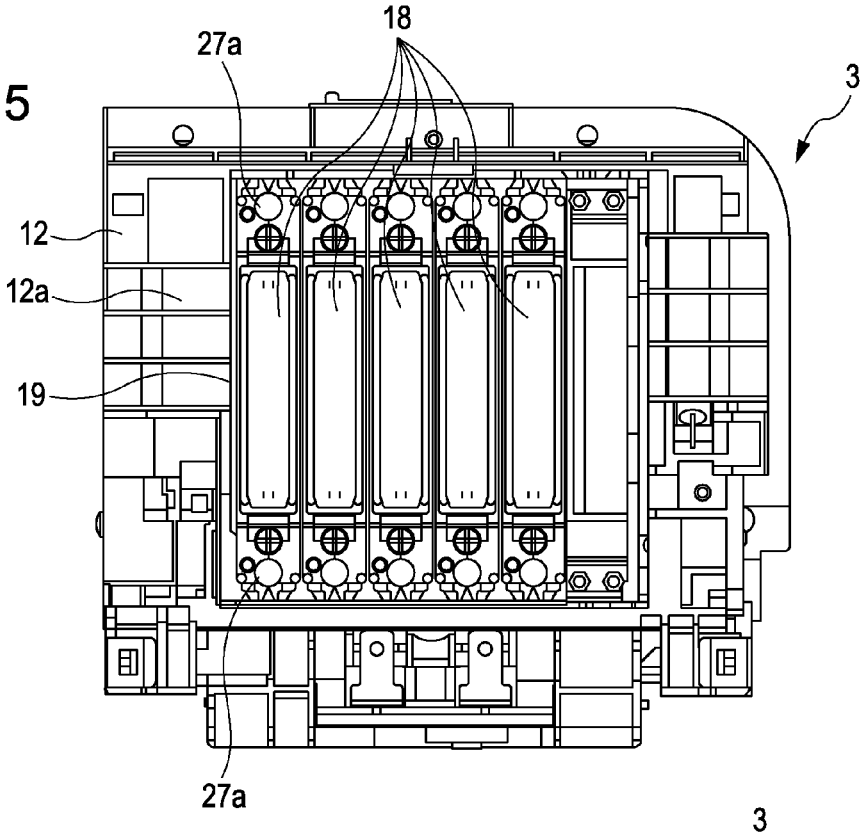
FIG. 5 is a lower surface view of a carriage.
Figure 6:
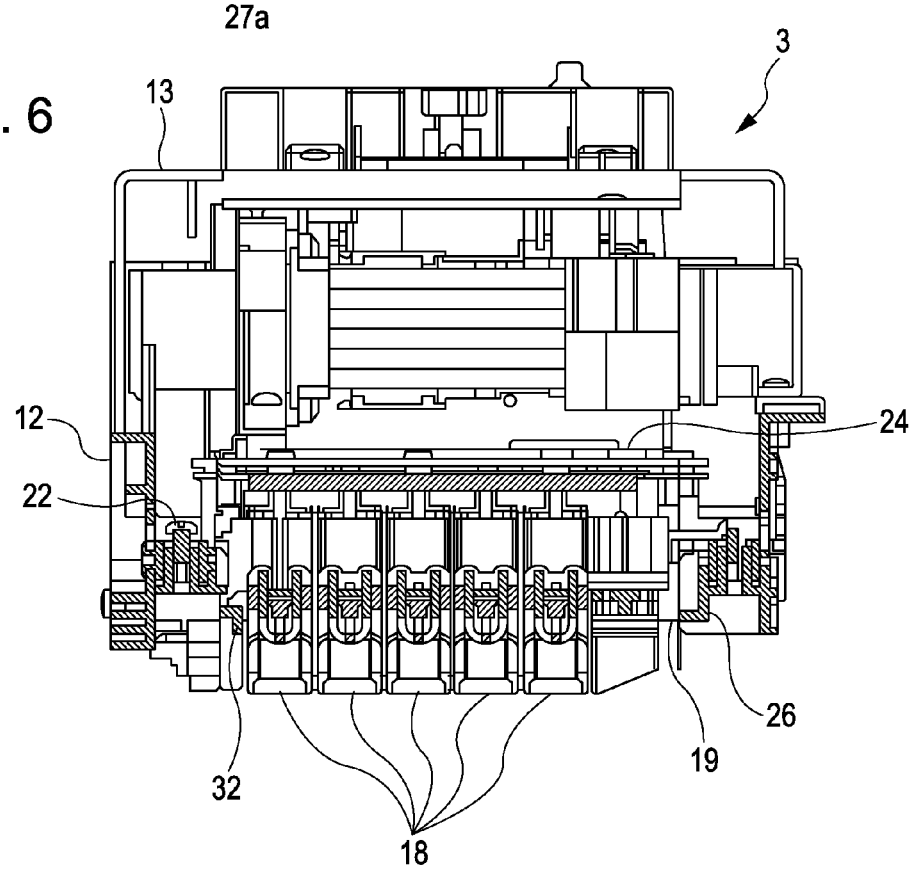
FIG. 6 is a cross-sectional diagram of line VI-VI of FIG. 3.

FIG. 3 is a planar (upper surface) view of the carriage 3, FIG. 4 is a right side surface view of the carriage 3, and FIG. 5 is a bottom surface (lower surface) view of the carriage 3. In addition, FIG. 6 is a cross-sectional diagram of line VI-VI of FIG. 3. Here, FIG. 3 illustrates a state where a cartridge cover 13 is removed. The carriage 3 is formed from a carriage body 12 where the head unit 17 (one type of liquid ejecting head unit of the invention) which will be described later is mounted in an inner portion thereof and the carriage cover 13 which covers an upper opening of the carriage body 12, and is a member with a hollow box shape which is able to be divided into upper and lower. The carriage body 12 is formed from a bottom plate section 12*a* with substantially a rectangular shape and side wall sections 12*b* which are each erected in an upward direction from an outer periphery edge on four sides of the bottom plate section 12*a*, and the head unit 17 is accommodated in a space which is surrounded by the bottom plate section 12*a* and the side wall sections 12*b*. A bottom opening 19 for exposing the nozzle forming surface 53 (refer to FIG. 12) of each recording head 18 of the head unit 17 which has been accommodated is provided in the bottom plate section 12*a*. Then, in a state where the head unit 17 is accommodated in the carriage body 12, the nozzle forming surface 53 of each recording head 18 protrudes further downward than the bottom portion of the carriage body 12 (a recording medium side during the recording operation) from the bottom opening 19 of the bottom plate section 12*a*.

Figure 7A:
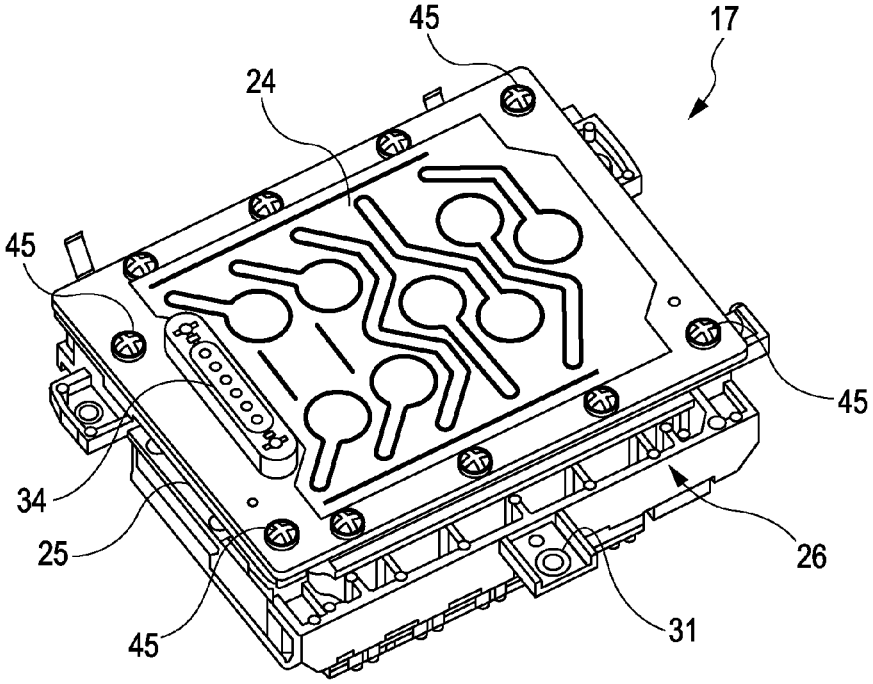
FIGS. 7A and 7B are perspective diagrams of a head unit.
Figure 7B:
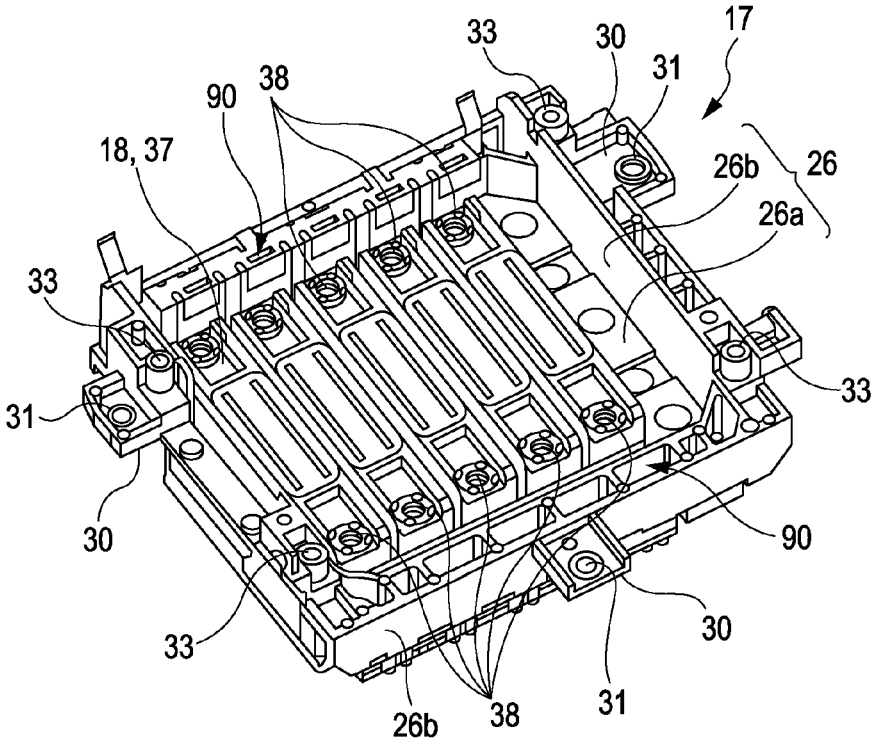
Figure 8:
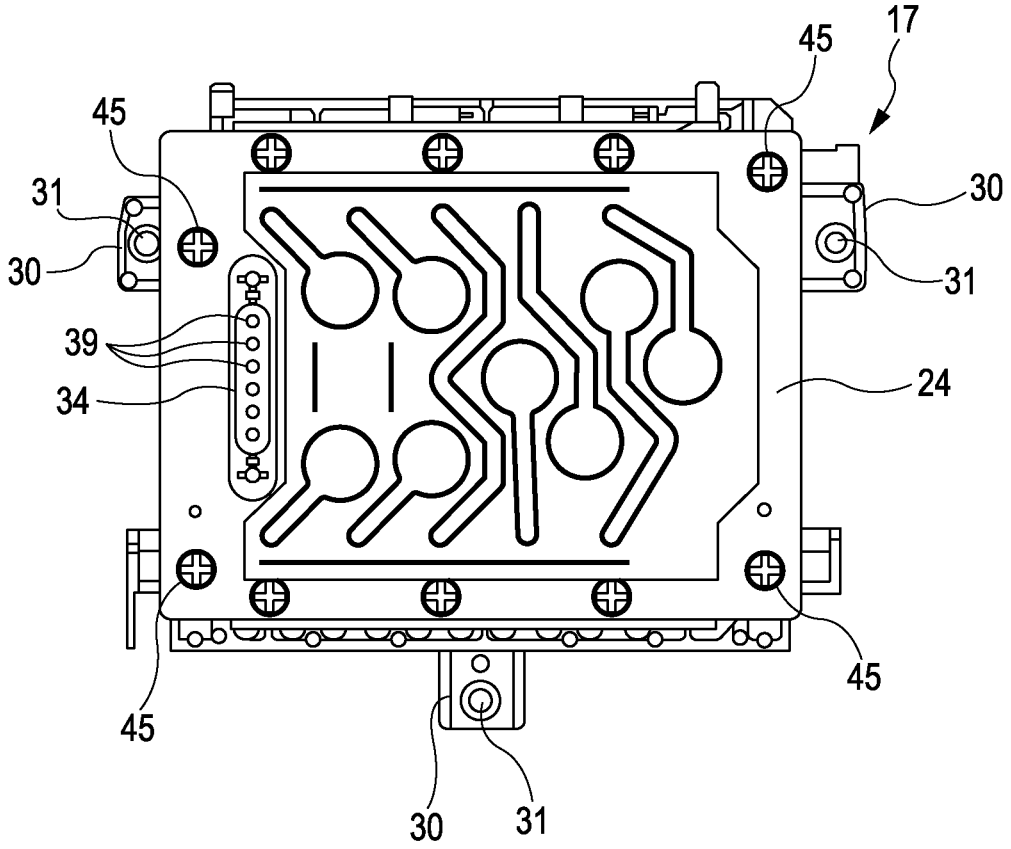
FIG. 8 is an upper surface view of a head unit.
Figure 9:
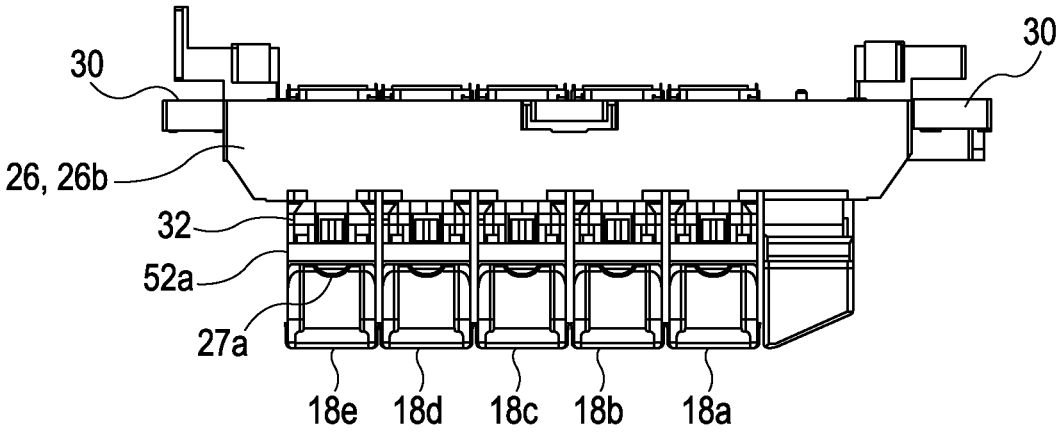
FIG. 9 is a front surface view of a head unit.
Figure 10:
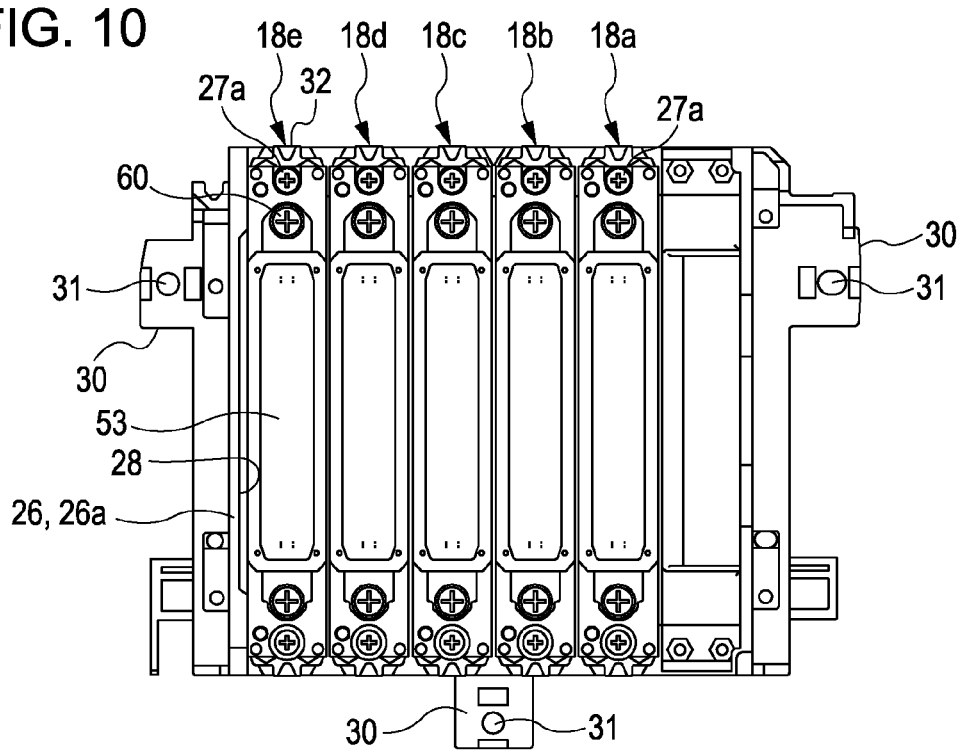
FIG. 10 is a lower surface view of a head unit.
Figure 11:
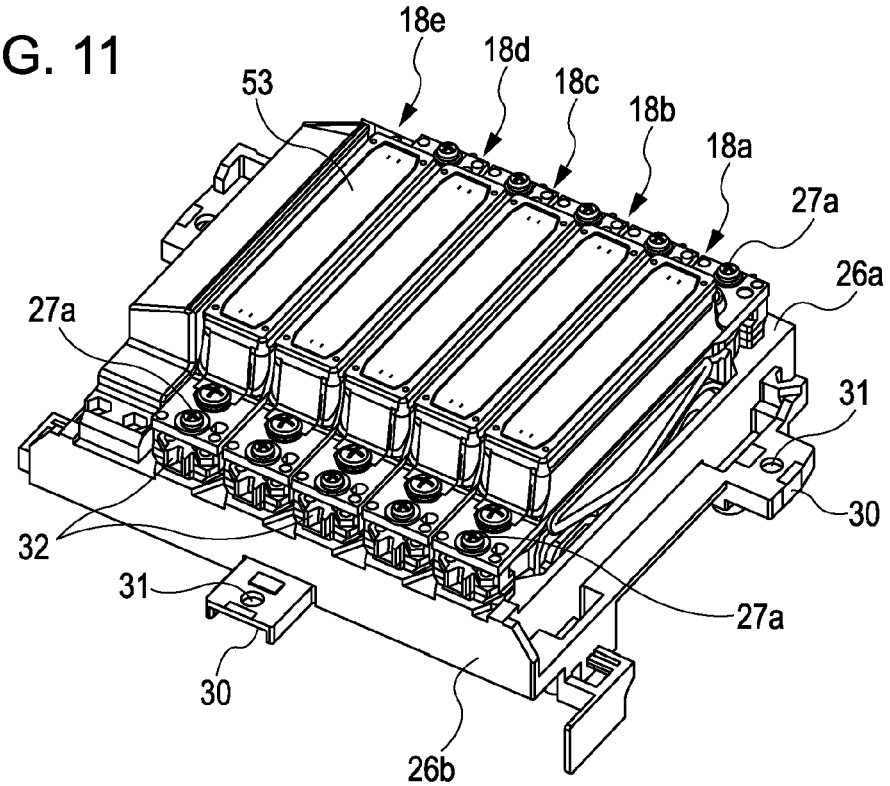
FIG. 11 is a perspective diagram of a lower surface side of a head unit.

FIGS. 7A and 7B are perspective diagrams of the head unit 17, where FIG. 7A is a state where a flow path member 24 is attached and FIG. 7B is a where the flow path member 24 is detached. In addition, FIG. 8 is an upper surface view of the head unit 17, FIG. 9 is a front surface view of the head unit 17 (a state where the flow path member 24 is detached), FIG. 10 is a lower surface view of the head unit 17, and FIG. 11 is a perspective diagram of a lower surface side of the head unit 17.

The head unit 17 which is one example of the liquid ejecting head unit makes a plurality of the recording heads 18 and the like into a unit, and is provided with a sub carriage 26 (one type of the head fixing member of the invention) where the recording heads 18 are attached and the flow path member 24.

The sub carriage 26 will be described in detail later, but is configured from a base section 26*a* with a plate shape where the recording head 18 is fixed and erect wall sections 26*b* which are erected in an upward direction from the outer periphery edge of the base section 26*a* and a box beam section 90 and is formed in a hollow box shape where the upper surface is open. A space which is surrounded by the base section 26*a*, the four sides of the erect wall sections 26*b*, and the box beam section 90 functions as an accommodating section which accommodates at least a portion of the recording head 18 (mainly a sub tank 37). The sub carriage 26 of the embodiment is manufactured using a metal, for example, aluminum and the rigidity is higher compared with the carriage body 12 and the carriage cover 13. Here, the material for the sub carriage 26 is not limited to metal and adoption of a composite resin is possible.

A head insertion opening 28 (which corresponds to an opening in the head fixing member in the claims) where the plurality of recording heads 18 are able to be inserted (that is, one is shared for each recording head 18) is opened in substantially the center portion of the base section 26*a* of the sub carriage 26. As a result, the base section 26*a* is a frame with a frame shape formed from four side sections. A fixing hole 29 is provided in the base section 26*a* to correspond with the attaching position of each recording head 18 (refer to FIG. 23). In the embodiment, a total of four of the fixing holes 29 are provided with two each in side sections of both sides in a direction, which corresponds to the nozzle arrangement direction (a direction which intersects with the head arrangement direction) to interpose the head insertion opening 28, with regard to the attachment position of one of the recording heads 18 to correspond to sub carriage insertion holes 69 of the spacer 32 which will be described later (refer to FIG. 26).

In the embodiment, as shown in FIG. 10, a total of five recording heads 18 of a first recording head 18*a*, a second recording head 18*b*, a third recording head 18*c*, a fourth recording head 18*d*, and a fifth recording head 18*e* are accommodated in the accommodation portion by the sub tank 37 which will be described below being inserted from below the head insertion opening 28 and are each fixed in the base section 26*a* to be lined up in a direction which intersects the nozzle row in a state of a spacer 32 is interposed between the recording heads 18 and the base section 26*a* (refer to FIG. 9 and the like).

As shown in FIGS. 7A and 7B, 8, and the like, flange sections 30 protrude toward the side direction in three out of the four sides of the erect wall sections 26*b* of the sub carriage 26. Insertion holes 31 are opened respectively in the flange sections 30 to correspond to attachment screw holes in three locations (not shown) which are opened in attachment positions of the head unit 17 in the bottom plate section 12*a* of the carriage body 12. Then, by head unit fixing screws 22 being fixed into the attachment screw holes via the insertion holes 31 in a state where the position of the insertion holes 31 which correspond to each match up with the respective attachment screw holes of the bottom plate section 12*a* of the carriage body 12, the head unit 17 is accommodated and fixed in an inner portion of the carriage body 12. In addition, the fixing screw holes 33 for fixing the flow path member 24 are provided in a total of four locations in an upper edge surface of the four sides of the erect wall sections 26*b* of the sub carriage 26.

The flow path member 24 is a member with a box shape which is shallow in the up and down direction, and for example, is manufactured using a composite resin. In an inner portion of the flow path member 24, an ink distribution flow path for each color (not shown) is segmented and formed to correspond to each flow path connection section 38 of the sub tank 37 (describer later) of each recording head 18. A tube connection section 34 is provided on the upper surface of the flow path member 24 (a surface on a side opposite to the surface on the side where the sub carriage 26 is fixed). As shown in FIG. 8, an introduction port 39 which corresponds to each color of ink are provided in plurality in an inner portion of the tube connection section 34. Each introduction port 39 communicates with the ink distribution path of the color which corresponds respectively thereto. Then, when the ink supply tube 14 described above is connected to the tube connection section 34, the ink distribution path for each color in the ink supply tube 14 and the introduction port 39 which correspond respectively thereto communicate in a liquid sealing state. Due to this, each color of ink which is sent from the ink cartridge side via the ink supply tube 14 is introduced respectively to the ink distribution flow path in the flow path member 24 via the introduction port 39. In addition, a connection flow path which is not shown is provided in a position which corresponds to the flow path connection section 38 of the sub tank 37 of each recording head 18 in a lower surface of the flow path member 24. Each connection flow path is configured so as to connect in a liquid sealing state by being inserted respectively into the flow path connection section 38 of the sub tank 37 of each recording head 18. Furthermore, in the four corners of the flow path member 24, flow path insertion holes (not shown) which correspond to the fixing screw holes 33 of the sub carriage 26 are formed in a state so as to respectively communicate in a plate thickness direction. When the flow path member 24 is fixed to the sub carriage 26, a flow path fixing screw 45 is fixed (engaged) in the fixing screw hole 33 via the flow path insertion hole. Then, the ink which passes through the ink distribution flow path of the inner portion of the flow path member 24 is supplied to the sub tank 37 of each recording head 18 via the connection flow path and the flow path connection section 38.

Figure 12:
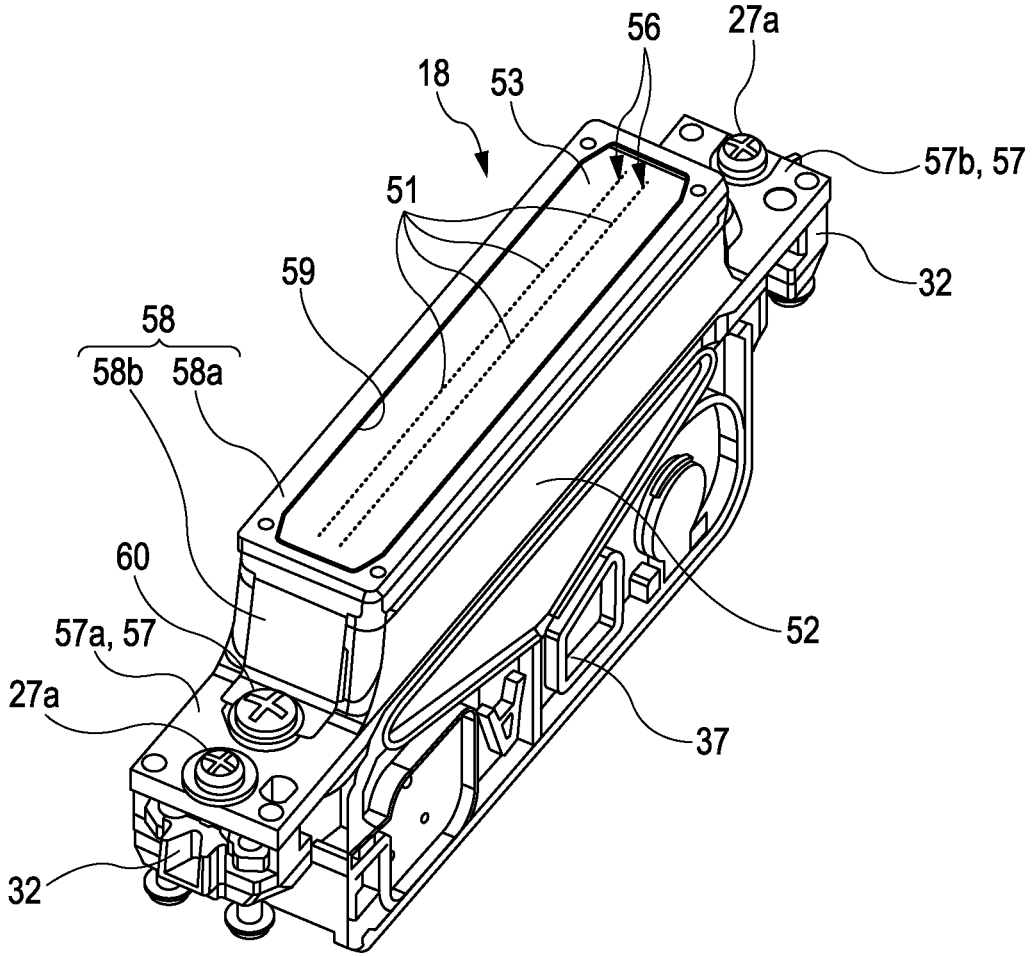
FIG. 12 is a perspective diagram describing a configuration of a recording head.
Figure 13A:
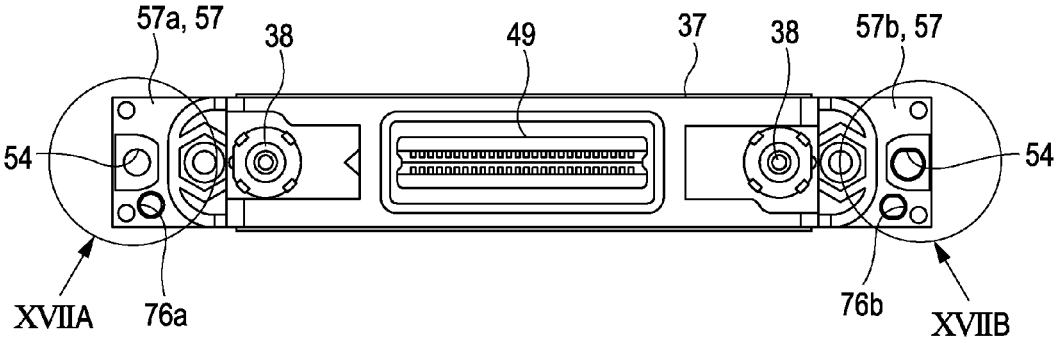
FIGS. 13A and 13B are upper surface views describing a configuration of a recording head.
Figure 13B:
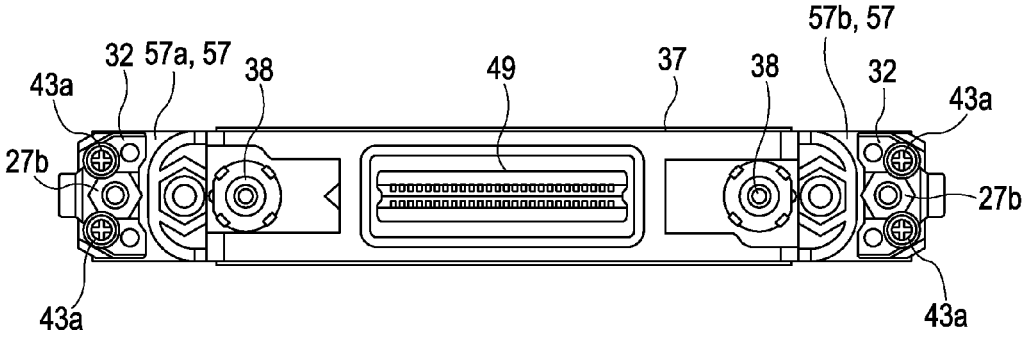
Figure 14A:
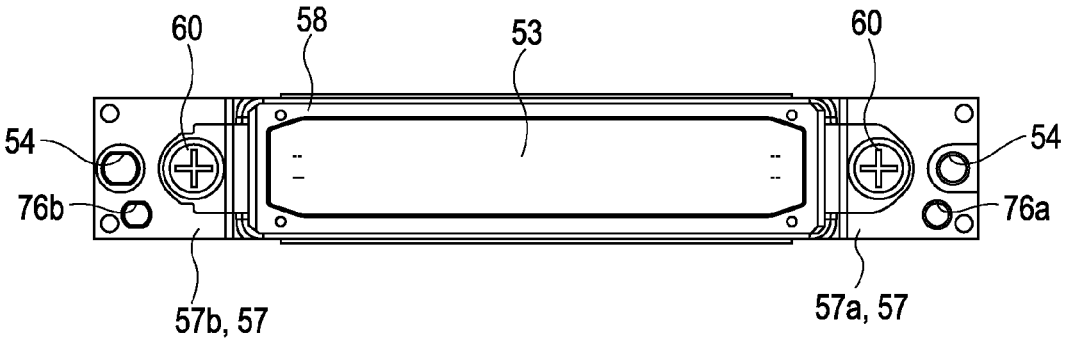
FIGS. 14A and 14B are lower surface views describing a configuration of a recording head.
Figure 14B:
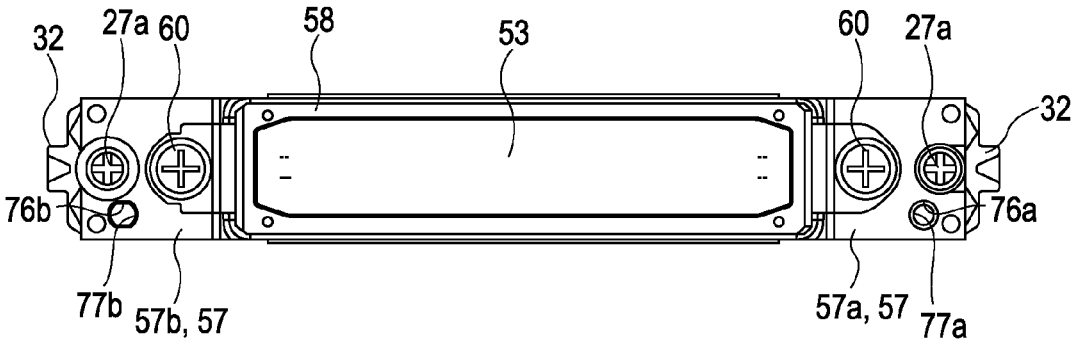
Figure 15A:
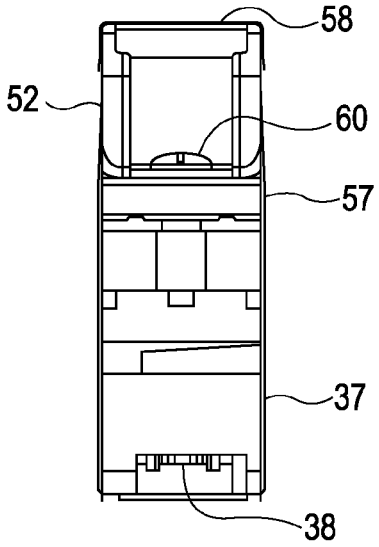
FIGS. 15A and 15B are front surface view describing a configuration of a recording head.
Figure 15B:
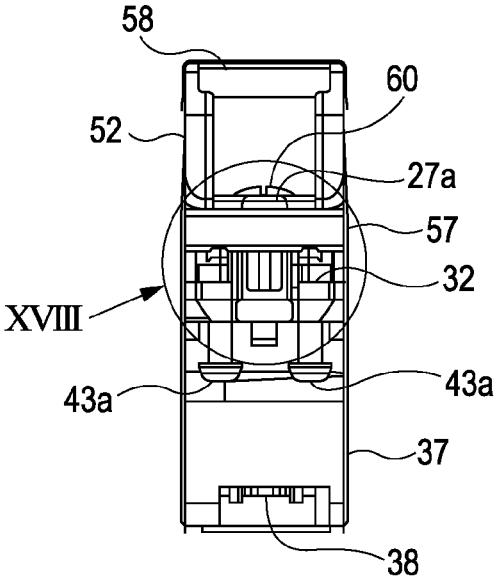
Figure 16A:
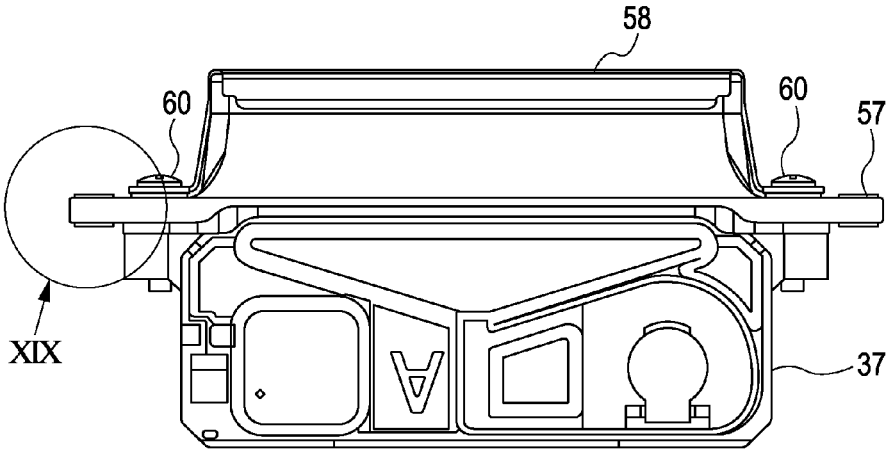
FIGS. 16A and 16B are right side surface view describing a configuration of a recording head.
Figure 16B:
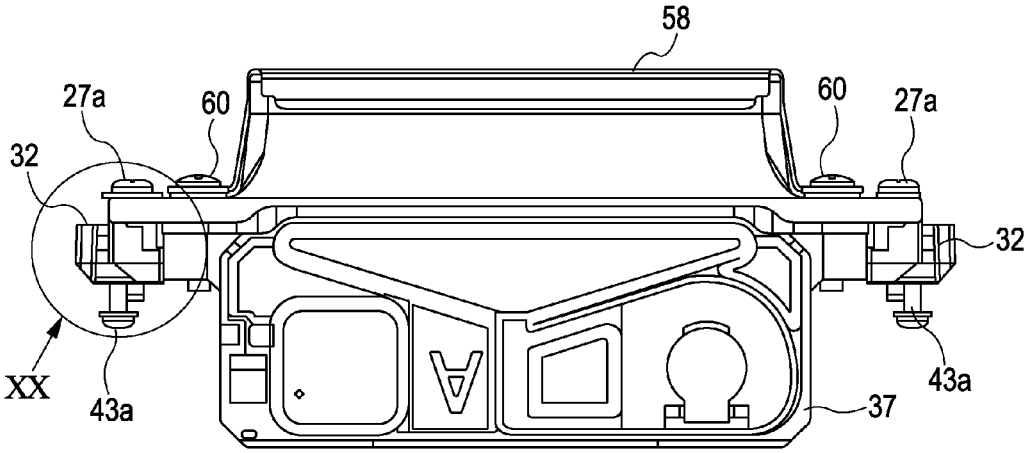

FIG. 12 is a perspective diagram describing a configuration of the recording head 18 (one type of liquid ejecting head). FIGS. 13A and 13B are upper surface views of the recording head 18, FIG. 13A is a state where the spacer 32 is not attached, and FIG. 13B is a state where the spacer 32 is attached. FIGS. 14A and 14B are lower surface views of the recording head 18, FIG. 14A is a state where the spacer 32 is not attached, and FIG. 14B is a state where the spacer 32 is attached. FIGS. 15A and 15B are front surface view of the recording head 18, FIG. 15A is a state where the spacer 32 is not attached, and FIG. 15B is a state where the spacer 32 is attached. FIGS. 16A and 16B are right side surface view of the recording head 18, FIG. 16A is a state where the spacer 32 is not attached, and FIG. 16B is a state where the spacer 32 is attached.

Figure 17A:
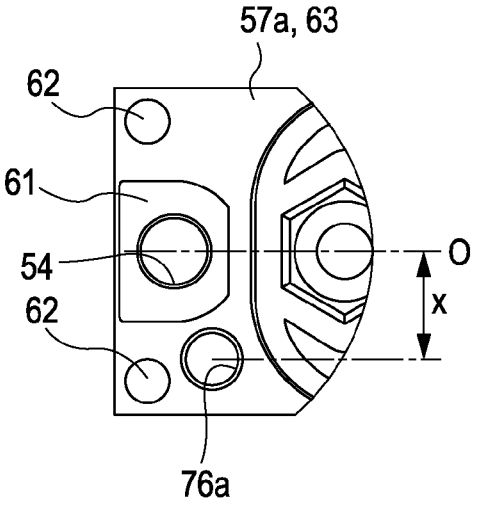
FIG. 17A is an enlarged diagram of a region XVIIA in FIG. 13A
Figure 17B:
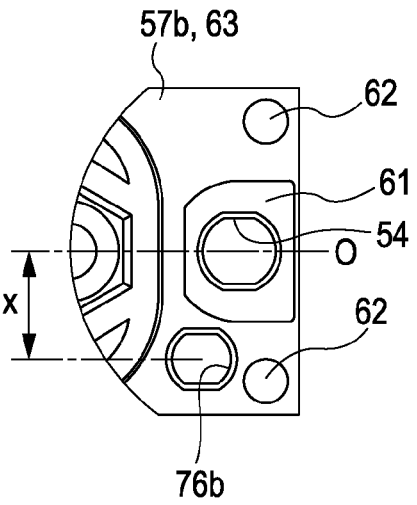
FIG. 17B is an enlarged diagram of a region XVIIB in FIG. 13A.
Figure 18:
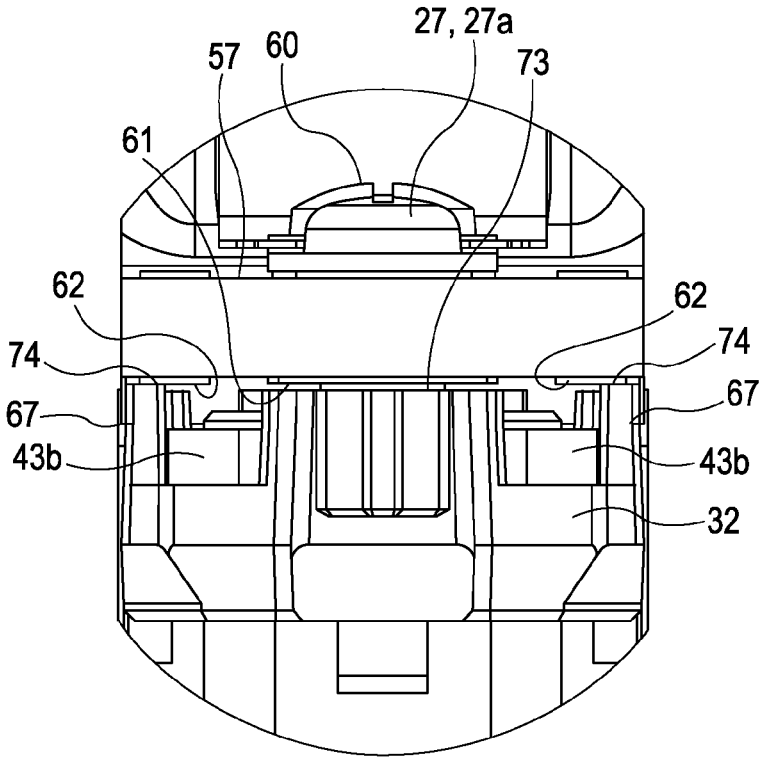
FIG. 18 is an enlarged diagram of a region XVIII in FIG. 15B.
Figure 19:
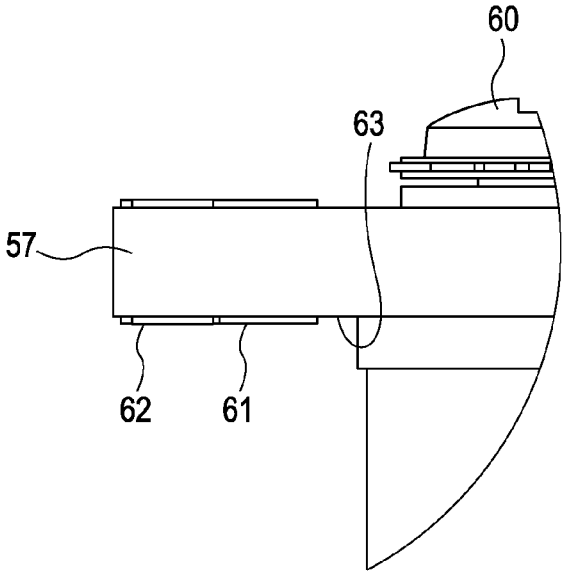
FIG. 19 is an enlarged diagram of a region XIX in FIG. 16A.
Figure 20:
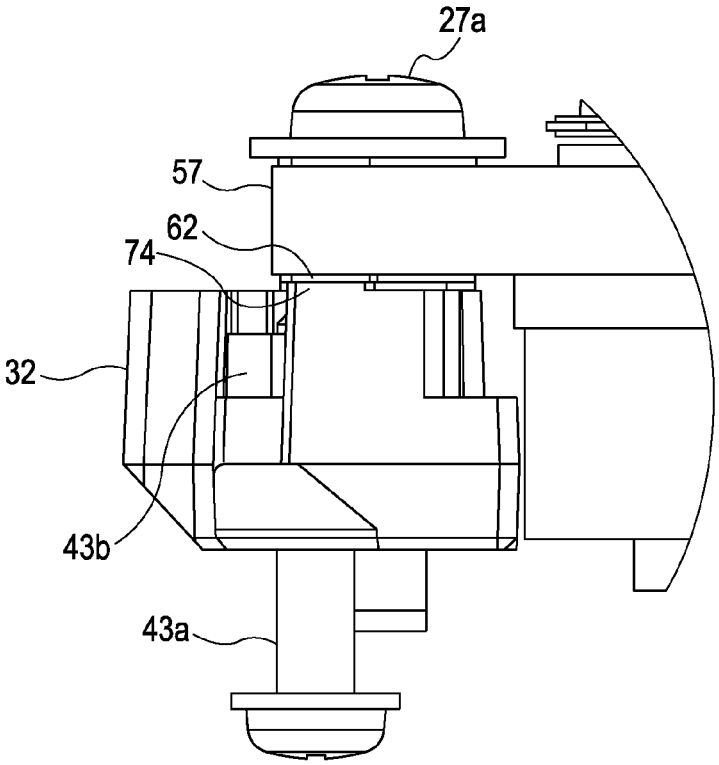
FIG. 20 is an enlarged diagram of a region XX in FIG. 16B.

In addition, FIG. 17A is an enlarged diagram of a region XVIIA in FIG. 13A, and FIG. 17B is an enlarged diagram of a region XVIIB in FIG. 13A. FIG. 18 is an enlarged diagram of a region XVIII in FIG. 15B. FIG. 19 is an enlarged diagram of a region XIX in FIG. 16A. Then, FIG. 20 is an enlarged diagram of a region XX in FIG. 16B. Here, since the basic configuration and the like is common to each of the recording heads 18, one out of the five recording heads 18 which is attached to the sub carriage 26 is shown as a representative.

The recording head 18 is provided with a flow path unit, which forms an ink flow path which includes a pressure chamber which communicates with a nozzle 51, and a pressure generating means (neither of which is shown) such as a piezoelectric vibrator or a heat element, which generates changes in pressure in the ink in the pressure chamber, in a head case 52. While having a long length in a nozzle row direction in a planar view, the recording head 18 of the embodiment is formed with a shape with a short width in a width direction which is orthogonal to the nozzle row. Then, the recording head 18 is configured so as to perform the recording operation where ink is ejected from the nozzle 51 and impacts on the recording medium such as recording paper due to the driving of the pressure generating means by a driving signal from the control section side of the printer 1 being applied to the pressure generating means. In the nozzle forming surface 53 of each recording head 18, a nozzle row 56 (nozzle group) is configured by a plurality of nozzles 51 which eject ink being lined up and the nozzle rows 56 are formed with two rows lined up in a direction which is orthogonal with the nozzle row. One nozzle row 56 is formed from, for example, 360 nozzles which are opened with a pitch of 360 dpi.

The head case 52 is a member with a hollow box shape. The flow path unit is fixed in a state where the nozzle forming surface 53 is exposed in the front edge side of the head case 52. In addition, the pressure generating means and the like are accommodated in the accommodation space section which is formed in an inner portion of the head case 52 and the sub tank 37 for supplying ink to the flow path unit side is mounted in a base edge surface side (upper surface side) on a side opposite to the front edge surface. In addition, flange sections 57 which protrude toward the side are respectively formed at both sides in the nozzle row direction in the upper surface side of the head case 52. As shown in FIGS. 17A to 17B, spacer attachment holes 54 are respectively opened in the flange sections 57 to correspond to head insertion holes 68 (refer to FIGS. 21A to 21E) of the spacers 32. When the spacers 32 are respectively attached to both sides of the flange section 57, a shaft section of a spacer fixing bolt 27*a* is inserted in the spacer attachment holes 54.

The spacer attachment holes 54 are formed in the center portions in the flange sections 57 in a flange width direction which is a direction which is orthogonal to the arrangement direction of both sides of the flange sections 57 (an arrangement direction of the fastening locations with the spacer 32 or a direction which is orthogonal to the nozzle row) in a state of penetrating in a thickness direction of the flange sections 57. The spacer attachment hole 54 (on the left side in FIG. 13A) out of the spacer attachment holes 54 of both sides of the flange sections 57 is a through hole with a circular hole shape in a planar view as shown in FIG. 17A and the inner diameter thereof is set to be slightly larger than the outer diameter of the shaft section of the spacer fixing bolt 27*a*. Due to this, the one of the spacer attachment holes 54 is configured to be able to be smoothly inserted with the shaft section of the spacer fixing bolt 27*a* and so that it is difficult for rattling to occur therebetween. On the other hand, the other spacer attachment bolt 54 (on the right side in FIG. 13A) is a slot with a long length in the arrangement direction of each of the spacer attachment holes 54 (the nozzle row direction) in a planar view as shown in FIG. 17B. The inner diameter (major axis) of the other space attachment hole 54 in the attachment hole arrangement direction is set to be larger than the outer diameter of the shaft section of the spacer fixing bolt 27*a* and the inner diameter (minor axis) in the flange width direction which is orthogonal to the attachment hole arrangement direction is matched up with the inner diameter of the one of the spacer attachment holes 54. In this manner, by one out of the spacer attachment holes 54 of both sides of the flange sections 57 being set as a circular hole and the other as a slot, error in the interval of the fixing hole 29 of the sub carriage 26 and the interval of the spacer attachment hole 54 is permitted within the range of the outer diameter of the slot when each of the spacers 32 which are respectively fixed in both of the flange sections 57 are screwed with regard to head attachment sections of the sub carriage 26.

As shown in FIGS. 17A and 17B, an opening periphery edge portion 61 of each spacer attachment hole 54 protrudes to the spacer 32 side in an attachment state more than a spacer fixing surface 63 of the flange section 57. The opening periphery edge portion 61 is a protrusion with a mound shape which is formed in a state of surrounding the opening periphery of the spacer attachment hole 54. In addition, contact convex sections 62 with circular shapes in a planar view are respectively formed at both outer sides in the spacer fixing surface 63 in the flange section 57 further to the flange width direction than the spacer attachment hole 54. In the embodiment, the contact convex portions 62 are respectively provided in corner portions on the outer side of both sides of the flange sections 57. The contact convex portions 62 protrude to the spacer 32 side in an attachment state more than the spacer fixing surface 63 of the flange section 57.

Furthermore, in one of the flange sections 57*a* (on the left side in FIG. 13A) out of the spacer fixing surface 63 of both sides of the flange sections 57, a circular hole 76*a* (equivalent to a head side positioning hole in the invention) which is a reference for positioning with regard to the spacer 32 is opened to correspond to a positioning hole 77*a* of the spacer 32 which will be described later. In the same manner, in the other flange section 57*b* (on the right side in FIG. 13A), a slot 76*b* (equivalent to a head side positioning hole in the invention) which is a reference for positioning with regard to the spacer 32 is provided to correspond to a positioning hole 77*b* of the spacer 32.

As shown in FIG. 17A, the circular hole 76*a* is provided in a position in the flange section 57*a* which does not interfere with the spacer attachment hole 54, the opening periphery edge portion 61, and the contact convex section 62 and in a position which is shifted to one side (lower side in the diagram) of the center line of the flange width direction (shown by reference symbol O in the diagram) in a state of penetrating in the thickness direction of the flange section 57*a*. The circular hole 76*a* is a through hole which has an opening with a circular shape in a planar view and the inner diameter thereof is set to be slightly larger than the outer diameter of a positioning pin 80*a* of a positioning tool 79 (refer to FIG. 22) which will be described later. In addition, as shown in FIG. 17B, the slot 76*b* is provided in a position which does not interfere with the spacer attachment hole 54, the opening periphery edge portion 61, and the contact convex section 62 and in a position which is shifted to one side (lower side in the diagram) of the center line of the flange width direction (shown by reference symbol O in the diagram) in a state of penetrating in the thickness direction of the flange section 57*b*. The slot 76*b* is a through hole which has an opening with an oval shape with a long length in a positioning hole arrangement direction in a planar view. The inner diameter (major axis) of the slot 76*b* in the positioning hole arrangement direction is set to be sufficiently larger than the outer diameter of a positioning pin 80*b* of the positioning tool 79 and the inner diameter (minor axis) of the slot 76*b* in the flange width direction is matched up with the inner diameter of the circular hole 76*a*. Here, the positioning of the spacer 32 with regard to the flange section 57 using the positioning tool 79 will be described later.

In the embodiment, the circular hole 76*a* and the slot 76*b* are provided in positions which are respectively shifted by the same distance (shown by the reference symbol x in the diagram) to one side (lower side in the diagram) in the width direction of the flange with regard to the center line O in the flange width direction. That is, the distance of the circular hole 76*a* from the center line O in the flange width direction and the distance of the slot 76*b* from the center line O in the flange width direction is set to be equal.

As shown in FIGS. 12, 14A, and 14B, a cover member 58, which protects the flow path unit and a periphery portion of the nozzle forming surface 53 from contact of the recording paper and the like, is attached to the front edge surface side of the head case 52. The cover member 58 is manufactured using a thin metal plate which has conductivity such as stainless steel. The cover member 58 in the embodiment has an outline configuration due to a frame section 58*a* with a frame shape, where an opening window section 59 is opened in a center portion, and side plate sections 58*b* which respectively extend from the edge portion on both sides of the frame section 58*a* in the nozzle row direction along the side surfaces of the head case 52 in a state of being attached to the head case 52. The front edge portion of each side plate section 58*b* is bent toward the outer side so as to become a shape which follows the flange section 57 and is screwed to the flange section 57 using a cover fixing screw 60. Other than the function of protecting the flow path unit and the periphery portion of the nozzle forming surface 53, the cover member 58 also has a function of adjusting the ground potential of the nozzle forming surface 53.

The sub tank 37 described above is a member which introduces ink from the flow path member 24 to the pressure chamber side of the recording head 18. The sub tank 37 opens and closes a valve according to the change in pressure inside thereof and has a self-sealing function which controls the introduction of ink to the pressure chamber side. The flow path connection section 38 where the connection flow path of the flow path member 24 described above is connected is provided at both edge portions of the rear edge surface (upper surface) of the sub tank 37 in the nozzle row direction. A gasket with a ring shape which is not shown is fitted in the flow path connection section 38 and the liquid sealing of the flow path member 24 is secured using the gasket. In addition, a driving substrate (not shown) for supplying a driving signal to the pressure generating means is provided in the inner portion of the sub tank 37. A connector 49 (refer to FIGS. 13A and 13B) which electrically connects a flexible cable (one type of wiring member; not shown) to the driving substrate is provided in an opening in the center portion of the rear edge surface of the sub tank 37.

Figure 21A:
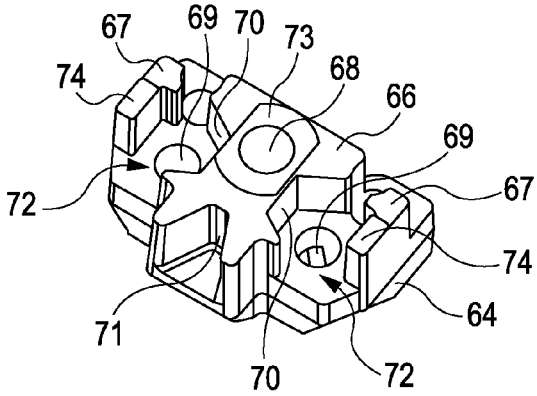
FIGS. 21A to 21E are diagrams describing a configuration of a spacer.
Figure 21B:
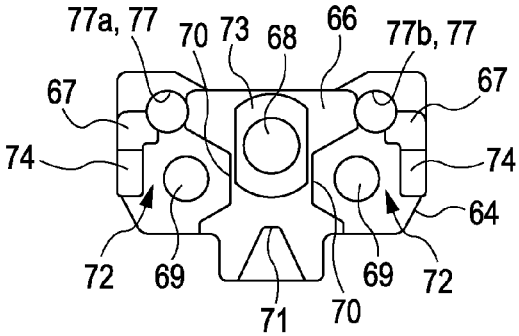
Figure 21C:
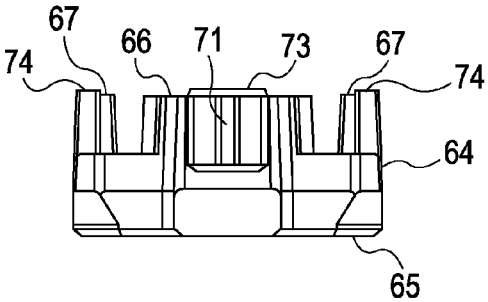
Figure 21D:
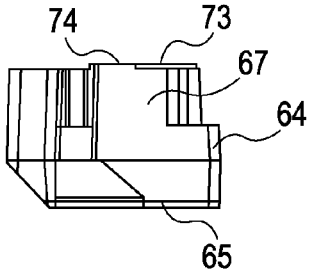
Figure 21E:
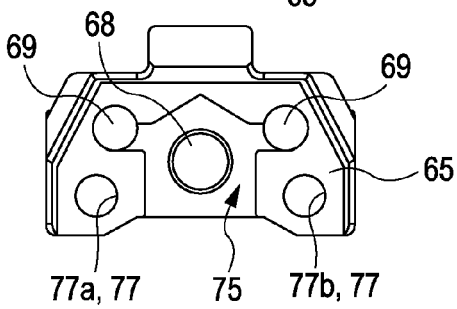

FIGS. 21A to 21E are diagrams describing a configuration of the spacer 32 (one type of intermediate member), FIG. 21A is a perspective view, FIG. 21B is an upper surface view, FIG. 21C is a front surface view, FIG. 21D is a right side surface view, and FIG. 21E is a lower surface view.

The spacers 32 of the embodiment are members formed from a composite resin and a total of two are attached with one each on the spacer fixing surfaces 63 (surface on the sub tank 37 side) on both sides of the flange sections 57 with regard to one of the recording heads 18 (refer to FIGS. 12 and 20). The spacers 32 have the same shape. Then, the recording head 18 is attached to the base section 26*a* of the sub carriage 26 via the spacer 32. As a result, the spacer 32 is a member which regulates the position in the height direction (a direction which is perpendicular to the nozzle forming surface) with regard to the base section 26*a* of the sub carriage 26. Accordingly, high accuracy is able to be demanded in relation to the dimensions from a base surface 65 of the spacer 32 to a front edge surface of a contact protrusion 74 which will be described later.

The spacer 32 has an outline configuration formed from a spacer body section 64 which has the base surface 65 which is disposed on the base section 26*a* of the sub carriage 26, a center protrusion section 66 which is formed in a center portion in the width direction of the spacer body section 64 (equivalent to the flange width direction in a state where the flange section 57 is attached), and side wall sections 67 which are formed so as to be separated on both sides in the width direction with regard to the center protrusion section 66. The dimensions of the spacer 32 in the width direction from a planar view approximately matches up with the dimensions of the flange section 57 in the width direction. In addition, in a state where the spacer 32 is correctly attached to the flange section 57, a portion of the center protrusion section 66 (which will be described later) protrudes slightly more to the side than a protrusion edge surface of the flange section 57.

The center protrusion section 66 protrudes from the space body section 64 toward a direction which is the flange section 57 side in an attachment state. A notch, which follows the shape of three sides of a head fixing nut 43*b* with a hexagonal shape in a planar view, is provided in a side surface on both sides in the width direction of the center protrusion section 66. The notch is a head fixing nut notch 70 which regulates the inner wall surface of the side wall section 67 and the posture of the head fixing nut 43*b* in the planar direction (that is, rotation when fastening). That is, a head fixing nut accommodating section 72 which accommodates the head fixing nut 43*b* is partitioned by the spacer body section 64, the head fixing nut notch 70, and the side wall section 67. Then, the head fixing nuts 43*b* are respectively fitted into each of the head fixing nut accommodating sections 72 at a stage before the spacer 32 is fixed to the flange section 57.

A portion of one of the center protrusion sections 66 in the depth direction (a side opposite to the sub tank 37 side in a state where the flange section 57 is attached) protrudes to the side from the spacer body section 64. A tool notch 71 with substantially a triangular shape in a planar view, where the width becomes gradually narrower from one side toward the other side in the depth direction, is provided in the protruding portion. A tool for head protection is fitted in the tool notch 71 when the recording head 18 is positioned in a head attachment section of the sub carriage 26.

The head insertion hole 68 is opened in the center portion of the center protrusion section 66 in the width direction to correspond to the spacer attachment hole 54 of the flange 57 in the recording head 18. The head insertion hole 68 is a through hole with a circular hole shape in a planar view as shown in FIG. 21B. The inner diameter of the head insertion hole 68 is set to be slightly larger than the outer diameter of the shaft section of the spacer fixing bolt 27*a* and matches up with the inner diameter of the spacer attachment hole 54. An insertion hole periphery edge portion 73 of the head insertion hole 68 protrudes more to the flange section 57 side in the attachment state than the protrusion edge surface of the center protrusion section 66. The insertion hole periphery edge portion 73 is a protrusion with a mound shape which surrounds the opening periphery of the head insertion hole 68 in a planar view and is provided in a position to correspond to the opening periphery edge portion 61 of the flange section 57.

Sub carriage insertion holes 69 are respectively opened in the head fixing nut accommodating section 72 which is provided on both sides of the center protrusion section 66 to correspond to the fixing holes 29 which are provided in the base section 26*a* of the sub carriage 26. The sub carriage insertion hole 69 is a through hole with a circular hole shape in a planar view as shown in FIG. 21B and the inner diameter is set to slightly larger than the outer diameter of the shaft section of the head fixing bolt 43*a*. Due to this, the sub carriage insertion hole 69 is configured to be able to be smoothly inserted with the shaft section of the head fixing bolt 43*a* and so that it is difficult for rattling to occur therebetween. In this manner, one of the head insertion holes 68 and two of the sub carriage insertion holes 69 are respectively provided in one of the spacers 32. That is, the fastening location using the spacer 32 and the head fixing bolt 43*a* and the head fixing nut 43*b* of the sub carriage 26 is further to the outer side in the width direction than the fastening location of the spacer 32 and the flange section 57 (refer to FIG. 26).

The side wall sections 67 which are respectively provided at both edge portions of the spacer 32 in the width direction are walls which protrude from the space body section 64 toward a direction which is the flange section 57 side in the attachment state and is formed in series with both side surfaces of the spacer body section 64 in the width direction. A protrusion edge surface of the side wall section 67 matches up as the same surface with the protrusion edge surface of the center protrusion section 66. In addition, in the protrusion edge surface of the side wall section 67, the contact protrusion section 74 protrudes from the protrusion edge surface toward the direction which is the flange section 57 side in the attachment state. The contact protrusion section 74 is provided in a position which is able to contact with the contact convex section 62 in a state where the spacer 32 is correctly attached to the flange section 57 (in a state of being fastened using the spacer fixing bolt 27*a* and the spacer fixing nut 27*b*). The front edge surface of the contact protrusion section 74 functions as a contact surface in the invention.

A spacer fixing nut accommodating section 75 is formed in a center portion in a width direction in the base surface 65 side of the spacer 32. The spacer fixing nut accommodating section 75 is an indent which follows the shape of a portion of the spacer fixing nut 27*b* in a planar view and is indented from the base surface 65 until a midway portion of the spacer 32 in the thickness direction. In a state where the spacer fixing nut 27*b* is fitted into the spacer fixing nut accommodating section 75 and is sat on a bottom portion of the indent, the posture in the planar direction of the spacer fixing nut 27*b* is regulated using the inner side surface of the spacer fixing nut accommodating section 75. That is, the rotation of the spacer fixing nut 27*b* when fastened to the spacer fixing bolt 27*a* is prevented. In addition, the head insertion hole 68 is opened in a bottom portion of the indent in the spacer fixing nut accommodating section 75. Furthermore, positioning holes 77 are opened in a total of two locations in a position, which is between the center protrusion section 66 and the side wall section 67 in the spacer 32 and is shifted from the head fixing nut accommodating section 72, in a state of penetrating in the thickness direction of the spacer 32. The positioning holes 77*a* and 77*b* are formed in positions which are left and right symmetrical with regard to the center portion of the spacer 32 in the width direction.

The positioning hole 77 in the embodiment is a through hole with a circular shape in a planar view. The positioning hole 77*a* which is one out of the pair of positioning holes 77 (left side in FIG. 21B) is provided in a position in the spacer 32 which corresponds to the circular hole 76*a* in a state where the spacer 32 is attached to the flange section 57*a*. On the other hand, the other positioning hole 77*b* (right side in FIG. 21B) is provided in a position in the spacer 32 which corresponds to the slot 76*b* in a state where the spacer 32 is attached to the flange section 57*b*. That is, the positioning hole 77*a* which corresponds to the circular hole 76*a* of the flange section 57*a* and the positioning hole 77*b* which corresponds to the slot 76*b* of the flange section 57*b* are respectively opened in each of the spacers 32.

Figure 22:
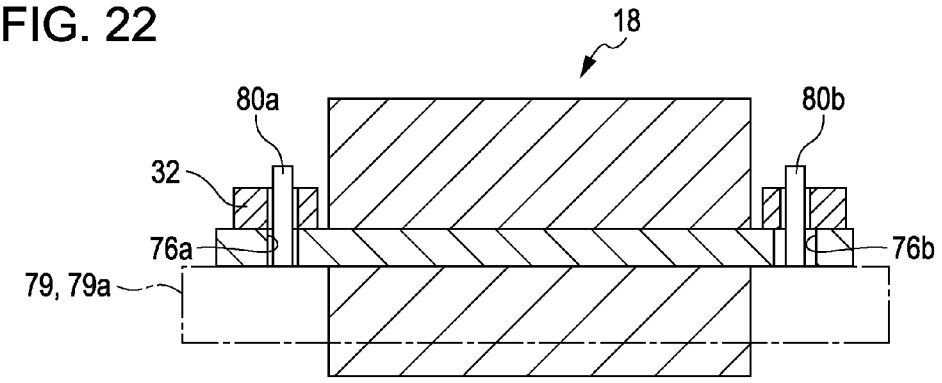
FIG. 22 is a schematic diagram describing a process for positioning a spacer with regard to a recording head.

Next, a process where each of the spacers 32 described above is positioned in the flange section 57*a* and 57*b* on both sides of the recording head 18 will be described with reference to the schematic diagram of FIG. 22. In the spacer position process, first, the recording head 18 is set in the positioning tool 79. A pair of positioning pins 80*a* and 80*b* are erected in the positioning tool 79 and the position of the recording head 18 in the planar direction (direction of a plane which is parallel with the nozzle forming surface) is regulated with regard to the positioning tool 79 by one positioning pin 80*a* being inserted in the circular hole 76*a* of the flange section 57*a* and the other positioning pin 80*b* being inserted in the slot 76*b* of the flange section 57*b*. Here, since the inner diameter of the slot 76*b* in the positioning hole arrangement direction is set to be larger than the external diameter of the positioning pin 80*a*, error in the interval of the circular hole 76*a* and the slot 76*b* and in the interval of the positioning pins 80*a* and 80*b* is permitted within the range of gap between the positioning pin 80*b* and the slot 76*b*.

The spacers 32 are respectively disposed at both sides of the flange sections 57*a* and 57*b* in the recording head 18 if the recording head 18 is set in the positioning tool 79. Each of the spacers 32 are respectively disposed in the flange section 57 with a symmetrical posture (that is, a posture of having been rotated by 180°) with the head body as a center with the insertion hole periphery edge portion 73 opposing the opening periphery edge portion 61 of the flange section 57 and the tool notches 71 facing the opposite side (outer side) to each other. At this time, the spacer 32 which is disposed in one flange section 57*a* is positioned with regard to the flange section 57*a* by one positioning pin 80*a* which protrudes from the circular hole 76*a* of the flange section 57*a* being inserted in the positioning hole 77*a*. Here, the rotation of the spacer 32 which is centered on the positioning hole 77*a* is regulated using another tool which is not shown. In the same manner, the spacer 32 which is disposed in the other flange section 57*b* is positioned with regard to the flange section 57*b* by the other positioning pin 80*b* which protrudes from the slot 76*b* of the flange section 57*b* being inserted in the positioning hole 77*b*. Then, each of the spacers 32 are fastened to the flange section 57 using the spacer fixing bolt 27*a* and the spacer fixing nut 27*b* in a state of having been positioned. In this manner, the spacers 32 are positioned and fixed with regard to the respective flange sections 57*a* and 57*b* with an orientation of being symmetrical with each other.

Here, in a state before the spacer 32 is disposed in the flange section 57 and is fastened using the spacer fixing bolt 27*a* and the spacer fixing nut 27*b*, while the contact convex section 62 and the contact protrusion section 74 are in contact with both edge portions separated as much as possible from the fastening location in the flange width direction, there is a gap G (refer to FIG. 26) between the fastening location (location where fastening is scheduled) of the spacer 32 and the flange section 57, that is, the opening periphery edge portion 61 of the spacer attachment hole 54 and the insertion hole periphery edge portion 73 of the head insertion hole 68. Due to this, in a state after the spacer 32 is fastened to the flange section 57 and is fastened using the spacer fixing bolt 27*a* and the spacer fixing nut 27*b*, the contact convex section 62 and the contact protrusion section 74 contact in a preferential manner rather than the fastening location of the spacer 32 and the flange section 57 and rather than other portions to the outer side of the fastening location of the spacer 32 and the sub carriage 26 in the flange width direction. Due to the contacting of the contact convex section 62 and the contact protrusion section 74, the position and the posture of the spacer 32 in the height direction is regulated with regard to the flange section 57. By adopting such a configuration, the occurrence of inclination is prevented in the direction which is orthogonal with a virtual line which connects the fastening locations of both sides of the flange section 57 between the recording head 18 and the spacer 32, in the embodiment, the short length direction of the recording head 18. Accordingly, the inclining of the recording head 18 in the short length direction with regard to the sub carriage 26 is prevented even in a state where the recording head 18 is attached to the sub carriage 26 by interposing the spacer 32.

If the spacers 32 are respectively fixed to both sides of the flange section 57 of the recording head 18, next, the positioning of the recording head 18 with regard to a head attachment section of the sub carriage 26 is performed. In the positioning process, for example, the position of the recording head 18 on the base section 26*a* is adjusted so that a plurality (at least two locations) of predetermined nozzles 51 which are set in advance in the nozzle forming surface 53 are positioned in a regulation position while the nozzle forming surface 53 of the recording head 18, which is set in the head attachment section in the base section 26*a* of the sub carriage 26, is monitored using imaging means such as a CCD camera or the like. If the recording head 18 which is a positioning target has been positioned, next, the spacer 32 which is attached to the recording head 18 is temporarily fixed with regard to the base section 26*a* using an adhesive agent. As the adhesive agent which is used in the temporary fixing, a so-called instantaneous adhesive agent with cyanoacrylate as a main component is appropriate, but it is possible to use an arbitrary adhesive if rigidity is exhibited to such an extent that the recording head 18 does not rattle and is fixed with regard to the sub carriage 26 in a state of being completely hardened. For example, it is possible to adopt an ultraviolet curable-type of adhesive agent. In this case, it is desirable that the spacer 32 or the sub carriage 26 be manufactured using a material which is transparent. Then, after the adhesive agent has hardened, the recording head 18*a* is permanently fixed in the regulation position of the base section 26*a* by the spacer 32 and the base section 26*a* being fastened using the head fixing bolt 43*a* and the head fixing nut 43*b*.

Each of the recording heads 18 are attached with regard to the sub carriage 26 in this sequence. After that, the flow path member 24 is fixed to the sub carriage 26. As described above, the flow path member 24 is fixed with regard to the sub carriage 26 using the flow path fixing screw 45. At this time, the connection flow path 40 of the flow path member 24 is connected in a liquid sealing state by being respectively inserted into the flow path connection section 38 of the sub tank 37 of each recording head 18. Here, the flow path member 24 may be fixed to the sub carriage 26 at a stage before each recording head 18 is attached to the sub carriage 26.

The head unit 17 is completed through the process above. The head unit 17 is accommodated in an inner portion of the carriage body 12 in a state where the nozzle forming surface 53 of each recording head 18 is exposed from the bottom opening 19 of the bottom plate section 12*a* of the carriage body 12 as described above, and after the posture such as the position, inclination, and the like of the head unit 17 is adjusted with regard to the carriage body 12, is fixed to the head unit fixing screw 22 by screwing.

Figure 23:
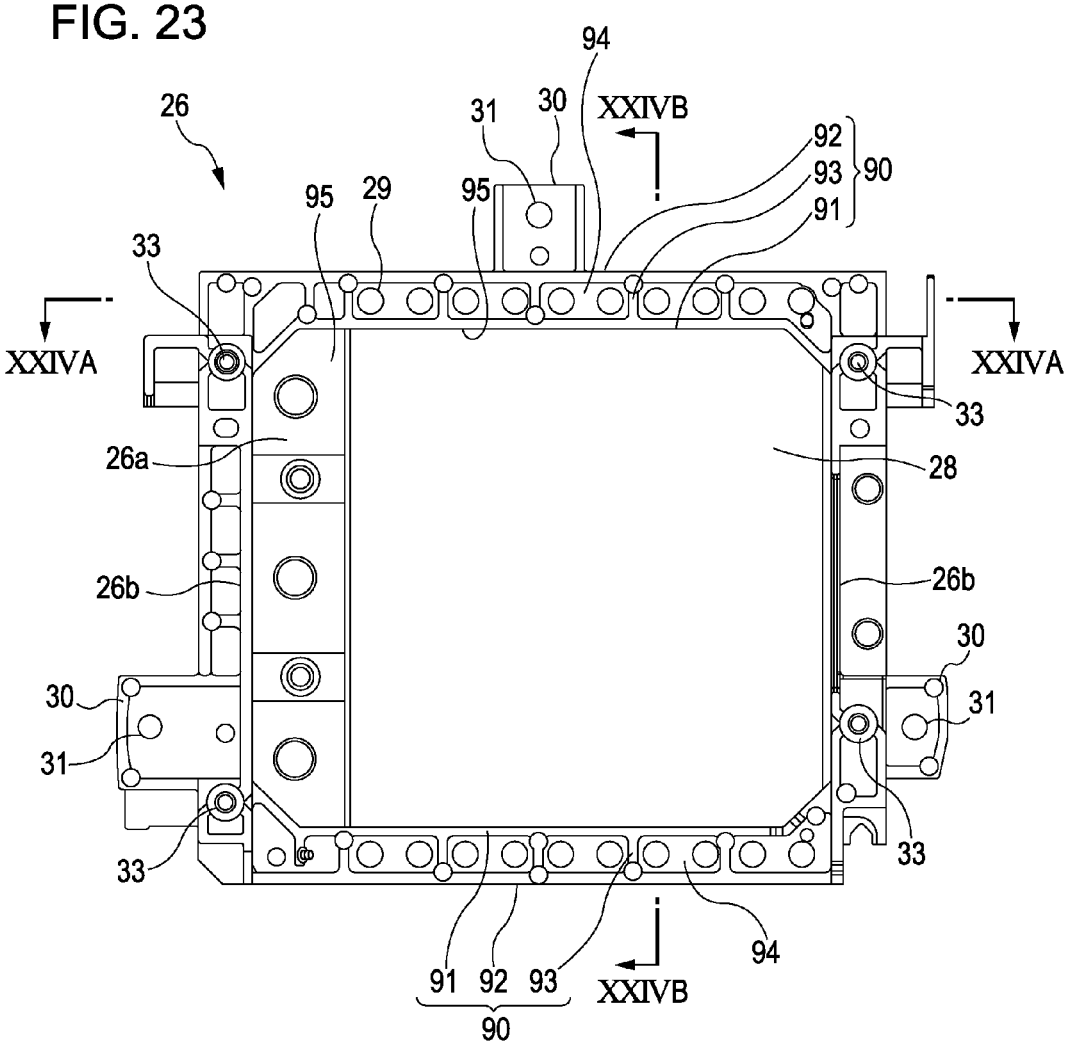
FIG. 23 is a planar diagram of a sub carriage.
Figure 24A:
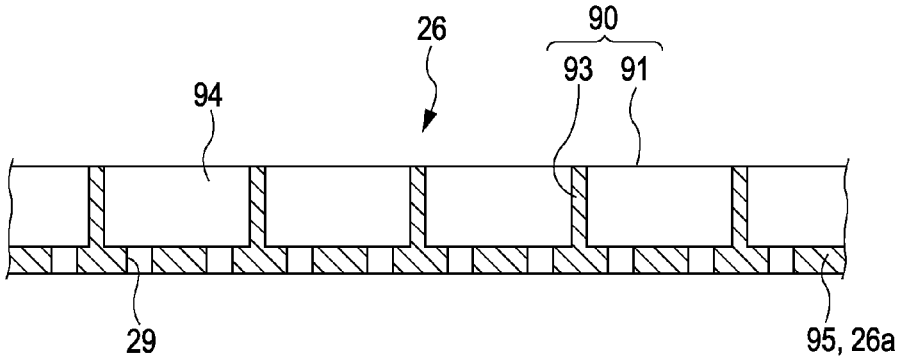
FIGS. 24A and 24B are a cross-sectional diagram of line XXIVA-XXIVA and a cross-sectional diagram of line XXIVB-XXIVB of FIG. 23.
Figure 24B:
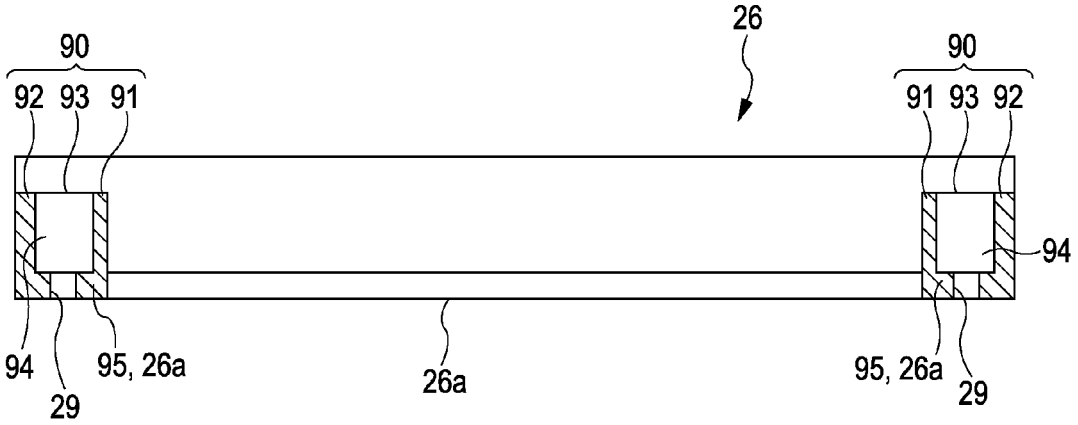

Here, the configuration of the sub carriage 26 will be described in detail. FIG. 23 is a planar diagram of the sub carriage 26, FIG. 24A is a cross-sectional diagram of line XXIVA-XXIVA of FIG. 23, and FIG. 24B is a cross-sectional diagram of line XXIVB-XXIVB of FIG. 23.

As shown in the diagram, the base section 26*a* which configures the sub carriage 26 has the head insertion opening 28 where the plurality of recording heads 18 is inserted in substantially the center portion (corresponding to the opening of the head fixing member of the claims). That is, the base section 26*a* is a frame with a frame shape formed from four side sections.

The erect wall section 26*b* and the box beam section 90 are erected in an opening edge portion 95 (a periphery portion of the head insertion opening 28 which is one portion of the base section 26*a*) of the head insertion opening 28 of the base section 26*a*.

Out of the four opening edge portions 95, the erect wall section 26*b* is a wall section which is erected in a side portion (a region on a left side and a right side of the head insertion opening 28 out of the base section 26*a* in FIG. 23) in the short side direction of the recording head 18 which is inserted in the head insertion opening 28.

Out of the four opening edge portions 95, the box beam section 90 is provided with a region (a region on a lower side and an upper side of the head insertion opening 28 out of the base section 26*a* in FIG. 23) where both edges of the flange section 57 of the recording head 18 which is inserted in the head insertion opening 28 are fixed. In detail, the box beam section 90 is configured from a first wall section 91, a second wall section 92, and a third wall section 93 which are erected in the opening edge portion 95 of the base section 26*a*. The first wall section 91 is a wall section which is provided in the base section 26*a* and has a side surface which faces the head insertion opening 28. The second wall section 92 is a wall section which is to the outer side of the first wall section 91 (the side opposite to the head insertion opening 28 of the first wall section 91) and is provided in the base section 26*a* to face the first wall section 91. The third wall section 93 is a wall section which is provided in the base section 26*a* to connect the first wall section 91 and the second wall section 92.

A plurality of box space sections 94 with a concave shape where the upper surface is open is formed by the first wall section 91, the second wall section 92, and the third wall section 93 which are configured in this manner.

In the embodiment, the upper opening of the box space section 94 is set as a rectangular opened shape (refer to FIG. 25) formed from a long side which has substantially the same length as one side of the recording head 18 in the short side direction (the first wall section 91 and a portion of the second wall section 92) and a short side which is shorter than the long side (the third wall section 93). Then, the box beam section 90 is provided so that the box space section 94 respectively opposes both sides of one recording head 18. That is, two of the box space sections 94 correspond to one of the recording heads 18.

The fixing hole 29 which is a through hole is provided in the sub carriage 26. The fixing hole 29 is opened in the nozzle 51 side (lower side in FIGS. 24A and 24B) of the recording head 18 and is continuous with the inner portion of the box beam section 90, that is, the box space section 94. In the embodiment, two of the fixing holes 29 are provided in each of the box space section 94.

Figure 25:
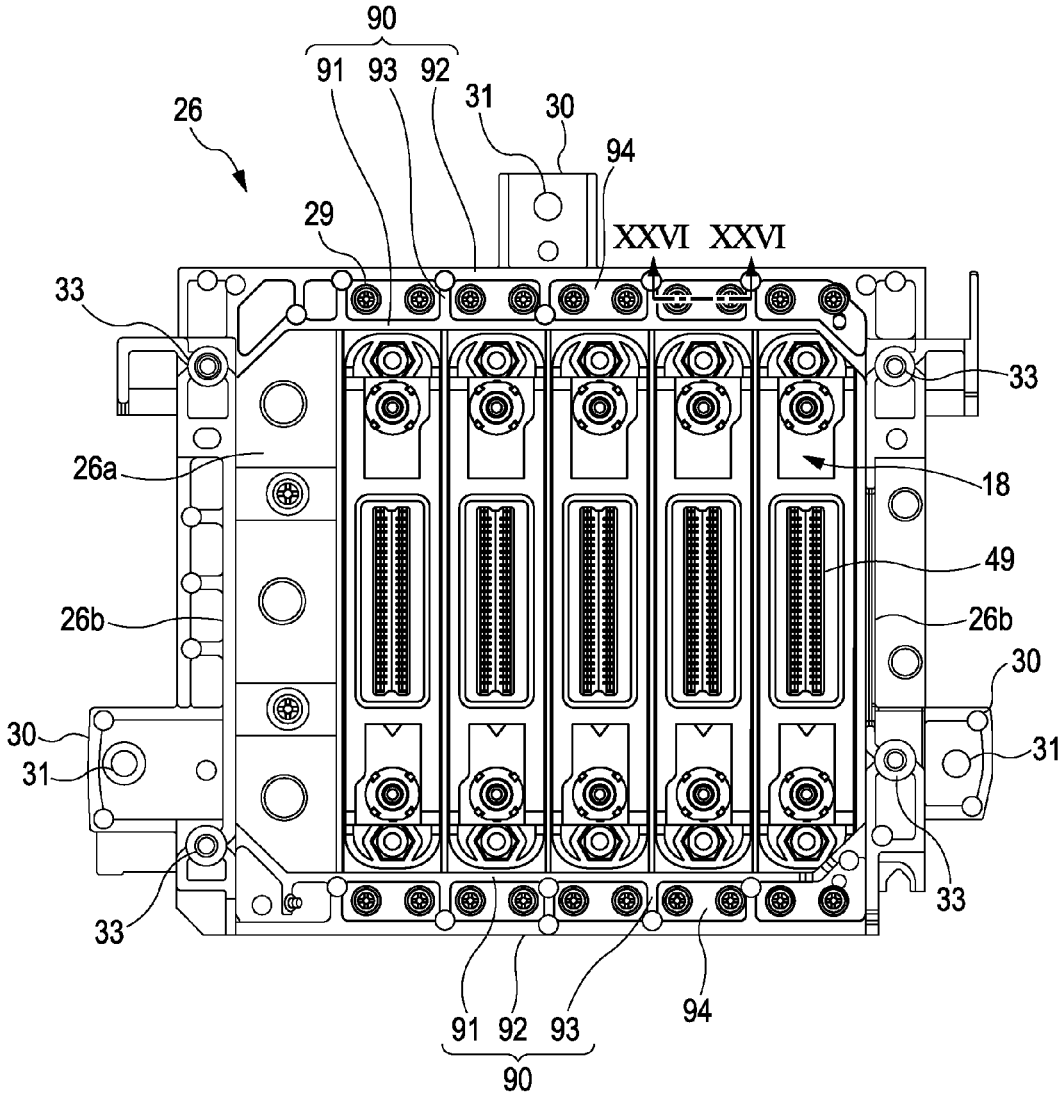
FIG. 25 is a planar diagram of a sub carriage where a recording head is fixed.
Figure 26:
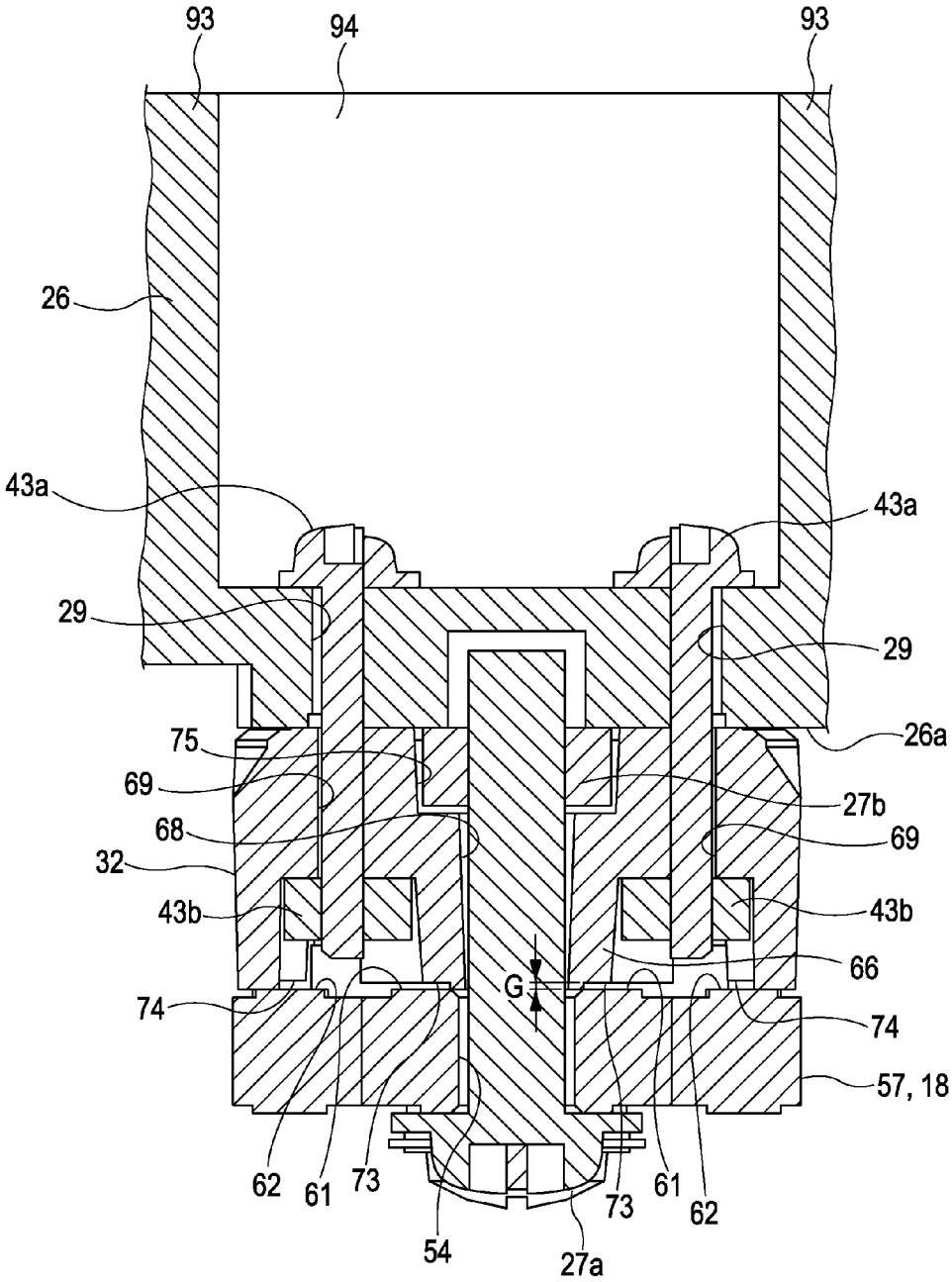
FIG. 26 is a cross-sectional diagram of line XXVI-XXVI of FIG. 25.

FIG. 25 is a planar diagram of the sub carriage where the recording head is fixed via the spacer, and FIG. 26 is a cross-sectional diagram of line XXVI-XXVI of FIG. 25.

As shown in the diagram, the spacer 32 is fixed in the flange section 57 of the recording head 18 and the spacer 32 is fixed to the sub carriage 26. That is, the recording head 18 is fixed to the sub carriage 26 via the spacer 32.

In detail, each of the spacers 32 is disposed in both sides of the flange sections 57 of the recording head 18 in a state where the insertion hole periphery edge portion 73 of each spacer 32 opposes the opening periphery edge portion 61 of the flange section 57. Then, the spacer 32 is fastened and fixed to the flange section 57 by the spacer fixing bolt 27*a* being inserted in the spacer attachment hole 54 and the head insertion hole 68 and being engaged with the spacer fixing nut 27*b*. Here, as described above, each of the spacers 32 is disposed in a predetermined position in the recording head 18 using the positioning tool 79.

Although not particularly shown, the spacer 32 which is provided in the flange section 57 is adhered to the base section 26*a* of the sub carriage 26 with an adhesive agent. Furthermore, the spacer 32 is fastened to the base section 26*a* using the head fixing bolt 43*a* and the head fixing nut 43*b* which are one example of fastening members. Here, as described above, each of the spacers 32 is attached to the sub carriage 26 so that the nozzle 51 of each recording head 18 is in the regulation position.

The head fixing bolt 43*a* is engaged with the head fixing nut 43*b* by being inserted in the fixing hole 29 from the box space section 94 side and being inserted in the sub carriage insertion hole 69 of the spacer 32. The spacer 32 is fastened to the sub carriage 26 by the head fixing bolt 43*a* being engaged with the head fixing nut 43*b* in this manner.

As described above, the box beam section 90 is provided in the sub carriage 26 where each recording head 18 is fixed via the spacer 32. Since the box beam section 90 is provided in the base section 26*a* with a frame shape in the sub carriage 26, the rigidity of the sub carriage 26 is improved. Since the rigidity of the sub carriage 26 is improved in this manner, the deforming of the sub carriage 26 is prevented. Accordingly, the deforming of the sub carriage 26 due to external force applied when the sub carriage 26 is attached to the carriage body 12, creep load, changes in the atmosphere (changes in temperature, humidity, and the like) and the like is prevented.

Since the deforming of the sub carriage 26 is prevented in this manner, positional deviation from the regulation position does not occur in the recording head 18 which is fixed to the sub carriage 26 in a state of being disposed in the regulation position and a reduction in the impact accuracy of ink is prevented.

In particular, in the embodiment, since the box beam section 90 is provided in a portion out of the base section 26*a* (a portion on an upper side and a lower side of FIG. 25) where the flange section 57 of the recording head 18 is fixed, the positional deviation of the recording head 18 which is fixed to the sub carriage 26 in a state of being disposed in the regulation position is prevented more reliably. Here, of course, the box beam section 90 may be provided at an arbitrary position in the base section 26*a*.

In addition, the box beam section 90 may be a reference position for regulating the position of the flow path member 24 when the flow path member 24 is attached to the recording head 18 (refer to FIGS. 7A and 7B). That is, when the flow path member 24 is disposed with each of the box space sections 94 of the box beam section 90 as a reference, the flow path member 24 may be disposed in the regulation position with regard to the recording head 18. Here, an example is shown in FIGS. 7A and 7B where one flow path member 25 is attached which is shared with regard to the plurality of recording heads 18, but this is not a limitation and the flow path member 24 may be attached for each recording head 18. In this case, each flow path member 24 is disposed with each of the box space sections 94 of the box beam section 90 as a reference. Due to this, each recording head 18 is attached by each flow path member 24 being positioned in the regulation position. By the flow path member 24 being provided for each recording head 18 in this manner, it is possible to position the flow path member 24 for each recording head 18, and in addition, it is possible to individually replace the flow path member 24 and maintenance operations such as repairing and replacing of the recording head 18 and the flow path member 24 is easy.

Here, as shown in FIG. 25, there is an electric section of the recording head 18 such as the connector 49 in the sub tank 37 side of the recording head 18. Since the electric section is accommodated in a space which is formed by the carriage body 12 and the carriage cover 13 (refer to FIG. 4), the entry of the ink into the electric section from the outside is prevented.

The box beam section 90 is also in the space. As shown in FIG. 26, the box space section 94 which is formed by the box beam section 90 communicates with the outside via the fixing hole 29 which is provided in the bottom portion of the box space section 94 and the sub carriage insertion hole 69 which is provided in the spacer 32. Accordingly, in a case where ink adheres to the spacer 32, there is a concern that the ink entering the space which runs along the surface of the head fixing bolt 43*a* and is formed by the carriage body 12 and the carriage cover 13 (refer to FIG. 4) even if the head fixing bolt 43*a* is inserted in the fixing hole 29 and the sub carriage insertion hole 69.

However, since the fixing hole 29 where the head fixing bolt 43*a* is inserted is provided in the bottom portion of the box space section 94, the ink which enters by running along the surface of the head fixing bolt 43*a* is retained in the box space section 94. By the ink which enters the box space section 94 from the outside in this manner being retained in the box space section 94, the ink is prevented from reaching the electric section such as the connector 49 of the recording head 18. Then, since the electric section is protected from the entry of ink in this manner, the head unit 17 is provided which improves reliability by preventing an erroneous operation occurring due to the electric section of the recording head shorting out and electronic parts breaking down.

As described above, since the box beam section 90 is provided in the sub carriage 26 where the recording head 18 is fixed in the head unit 17 of the embodiment, the sub carriage 26 has high rigidity. Accordingly, the deforming of the sub carriage 26 for various reasons is prevented. By the deforming of the sub carriage 26 being prevented, positional deviation from the regulation position does not occur in the recording head 18 which is fixed to the sub carriage 26 in a state of being disposed in the regulation position and a reduction in the impact accuracy of ink is prevented.

In addition, since the fixing hole 29, where the head fixing bolt 43*a* which fixes the recording head 18 (the spacer 32) to the sub carriage 26 is inserted, is provided in the bottom portion of the box space section 94, the ink which enters along the surface of the head fixing bolt 43*a* is retained in the box space section 94. Due to this, the head unit 17 is provided which improves reliability by preventing the ink reaching the electric section such as the connector 49 of the recording head 18.

In addition, it is possible to standardize parts and standardize the shape and dimensions management of the spacer 32 which is fixed in both sides of the flange sections 57*a* and 57*b* in the recording head 18 since a configuration is adopted where the head unit 17 of the embodiment has the flange sections 57, where the spacers 32 are fixed in the recording head 18, on both sides interposing the head case 52, in the flange sections 57*a* and 57*b*, is provided with the spacer attachment holes 54 where the spacers 32 are attached respectively in the center portion in the width direction which is orthogonal with the nozzle row 56 in the recording head 18 and is provided with the circular hole 76*a* and the slot 76*b* which are references for positioning with regard to the spacers 32 in a position which is shifted from the center line O in the width direction, is provided with the positioning holes 77*a* and 77*b* which are references for positioning with regard to each of the flange sections 57*a* and 57*b* respectively in each of the spacers 32 in a position which corresponds to the circular hole 76*a* and the slot 76*b* in each of the flange sections 57*a* and 57*b*, and the spacers 32 are respectively fixed with an orientation so as to be symmetrical to each other in a state of having been positioned so that the positions of the positioning holes 77*a* and 77*b* match with regard to the circular hole 76*a* and the slot 76*b* in both sides of the flange section 57*a* and 57*b*. Due to this, variation in the shape and dimensions of the spacer 32 is reduced. As a result, it is possible to suppress as much as possible the inclining of the recording head 18 with regard to the sub carriage 26 which is caused by variation in the shape and dimensions of the spacer 32. In particular, since the positioning holes 77*a* and 77*b* are provided in a total of two locations in each of the spacers 32 to respectively correspond to the circular hole 76*a* and the slot 76*b* in the flange sections 57*a* and 57*b*, it is possible to standardize each of the spacers 32 even with a configuration where it is necessary that the circular hole 76*a* and the slot 76*b* be provided in the flange section 57 in a position which is shifted from the center line in the width direction from the relationship where the spacer attachment hole 54 is provided in a center portion of the flange section 57 so as to reduce the size of the spacer 32 as much as possible. Due to this, variation in the shape and dimensions of each of the spacers 32 is reduced.

In addition, since the width in a direction which is orthogonal to the nozzle row 56 in the spacer 32 is formed to narrower in width than the width in a direction which is orthogonal to the nozzle row in the recording head 18, interference by an intermediate member between the adjacent liquid ejecting heads is prevented in a case of disposing the plurality of recording heads 18 are lined up. Due to this, it is possible to narrow the pitch between each of the recording head 18 in the sub carriage 26. As a result, it is possible to reduce the size of the head unit 17.

Here, it is desirable to use each an object which is manufactured using the same metal mold at least as the spacers 32 which is fixed to both sides of the flange sections 57 of the same recording head 18. Due to this, it is possible match up the dimensions and shape of each of the spacers 32 which are fixed to both sides of the flange section 57 in the same recording head 18 as much as possible. Due to this, it is possible to more reliably prevent the inclining of the recording head 18 with regard to the sub carriage 26.

In addition, it is desirable that a configuration be adopted where a wrapping process which polishes and planarizes is carried out at the same time with regard to the front edge surface of the contact protrusion 74 in each of the spacers 32 which is fixed to both sides of the flange sections 57 of the same recording head 18. Due to such a configuration, it is possible to more reliably match up the dimensions and shape of each of the spacers 32. In particular, since it is possible to match up the dimensions in the height direction from the base surface 65 to the front edge surface of the contact protrusion section 74 in the spacer 32 between each of the spacers 32 with high accuracy, it is possible to further reliably prevent the inclining of the recording head 18 with regard to the sub carriage 26.

Here, the invention is not limited to the embodiment described above and various modifications are possible based on the description of the scope of the claims.

For example, in the embodiment, the recording head 18 is fixed to the sub carriage 26 via the spacer 32, but there may be an ink jet recording head which is provided with a recording head which is directly fixed to the sub carriage 26 not via the spacer 32. In addition, the head fixing bolt 43*a* and the head fixing nut 43*b* is used as the fastening members, but the invention is not limited to this. For example, the recording head may be fixed to the sub carriage 26 by an internal thread being cut into the fixing hole 29 and the head fixing bolt 43*a* being engaged with the fixing hole 29. In addition, two fixing holes 29 are provided in one of the box space section 94 in the box beam section 90, but the invention is not limited to this and one or three or more may be provided. In addition, the box beam section 90 is configured so as correspond to two box space sections 94 with regard to one of the recording heads 18, but the invention is not limited to this. The box beam section 90 may be configured so as correspond to one or three or more box space sections 94 with regard to one of the recording heads 18 or the box beam section 90 may be configured irrespective to the number of recording heads 18.

In addition to this, in the embodiment, a configuration is shown as an example where ejecting of ink is performed while the recording head 18 reciprocates and moves with regard to the recording medium, but the invention is not limited thereto. For example, it is possible to adopt a configuration where the ejecting of ink is performed while the recording medium moves with regard to the recording head 18 in a state where the position of the recording head 18 is fixed.

Then, the ink jet printer 1 which is one type of liquid ejecting apparatus is described above as an example, but it is possible to also apply the invention to other liquid ejecting apparatuses which adopt a configuration where the liquid ejecting head is fixed in a state of interposing an intermediate member with regard to the head fixing member. For example, it is possible to apply the invention also to a display manufacturing device which manufacturers a color filter such as for a liquid crystal display, an electrode manufacturing device which forms an electrode such as an organic EL (Electro Luminescence) display and a FED (Field Emission Display), a chip manufacturing device which manufactures bio chips (biological elements), a micro-pipette which supplies accurate amounts of extremely small amounts of a sample solution.

What is claimed is:

1. A liquid ejecting head unit comprising:

a plurality of liquid ejecting heads each of which has a nozzle which ejects liquid; and a head fixing member which has an opening where the plurality of liquid ejecting heads are inserted and in which each of the plurality of liquid ejecting heads are fixed to an opening edge portion of the opening, wherein the opening edge portion comprises a first box beam section and a second box beam section that are separated by the opening, wherein each of the first and second box beam sections have walls defining at least one inner cavity that is separated from the opening by at least one of said walls, and wherein each of the plurality liquid ejecting heads are fixed to the first and second box beam sections.

2. The liquid ejecting head unit according to claim 1, wherein a through hole, which passes through an inner portion of the box beam section and opens to a nozzle side of the liquid ejecting head, is provided in the head fixing member, and the liquid ejecting head is fastened to the head fixing member using a fastening member which is inserted in the through hole.

3. The liquid ejecting head unit according to claim 1, wherein a through hole, which passes through an inner portion of the box beam section and opens to a nozzle side of the liquid ejecting head, is provided in the head fixing member, an intermediate member which is interposed between the liquid ejecting head and the head fixing member is attached in the liquid ejecting head, and the intermediate member is fastened to the head fixing member by a fastening member which is inserted in the through hole.

4. The liquid ejecting head unit according to claim 1, wherein the head fixing member is provided with a base section with a plate shape which is provided with the opening, and the box beam section is configured from a first wall section which has a side surface which faces the opening and is erected in the base section, a second wall section which is positioned further to the outside than the first wall section and is erected in the base section so as to oppose the first wall section, and a third wall section which is erected in the base section so as to connect the first wall section and the second wall section.

5. The liquid ejecting head unit according to claim 1, wherein the liquid ejecting head has a nozzle row where a plurality of nozzles are arranged in a line and both edge portions in an arrangement direction of the nozzle row are fixed to the opening edge portion of the head fixing member, and the box beam section is provided in a region where both edge portions of the head fixing member are fixed.

6. A liquid ejecting apparatus having a liquid ejecting head unit comprising:

a plurality of liquid ejecting heads each of which has a nozzle which ejects liquid; and a head fixing member which has an opening where the plurality of liquid ejecting heads are inserted and in which each of the plurality of liquid ejecting heads are fixed to an opening edge portion of the opening, wherein the opening edge portion comprises a first box beam section and a second box beam section that are separated by the opening, wherein each of the first and second box beam sections have walls defining at least one inner cavity that is separated from the opening by at least one of said walls, and wherein each of the plurality liquid ejecting heads are fixed to the first and second box beam sections.

7. The liquid ejecting apparatus of claim 6 wherein a through hole, which passes through an inner portion of the box beam section and opens to a nozzle side of the liquid ejecting head, is provided in the head fixing member, and the liquid ejecting head is fastened to the head fixing member using a fastening member which is inserted in the through hole.

8. The liquid ejecting apparatus of claim 6 wherein a through hole, which passes through an inner portion of the box beam section and opens to a nozzle side of the liquid ejecting head, is provided in the head fixing member, an intermediate member which is interposed between the liquid ejecting head and the head fixing member is attached in the liquid ejecting head, and the intermediate member is fastened to the head fixing member by a fastening member which is inserted in the through hole.

9. The liquid ejecting apparatus of claim 6 wherein the head fixing member is provided with a base section with a plate shape which is provided with the opening, and the box beam section is configured from a first wall section which has a side surface which faces the opening and is erected in the base section, a second wall section which is positioned further to the outside than the first wall section and is erected in the base section so as to oppose the first wall section, and a third wall section which is erected in the base section so as to connect the first wall section and the second wall section.

10. The liquid ejecting apparatus of claim 6 wherein the liquid ejecting head has a nozzle row where a plurality of nozzles are arranged in a line and both edge portions in an arrangement direction of the nozzle row are fixed to the opening edge portion of the head fixing member, and the box beam section is provided in a region where both edge portions of the head fixing member are fixed.

11. A head fixing member comprising:

a head fixing member which has an opening where a plurality of liquid ejecting heads are able to be inserted; and an opening edge portion including a first box beam section and a second box beam section that are separated by the opening, wherein each of the first and second box beam sections have walls defining at least one inner cavity that is separated from the opening by at least one of said walls, and wherein each of the plurality liquid ejecting heads are able to be fixed to the first and second box beam sections.

12. The head fixing member according to claim 11, further comprising:

a through hole, which passes through an inner portion of the first and second box beam sections and opens to a nozzle side of the plurality of liquid ejecting heads, wherein each of the plurality of liquid ejecting heads is able to be fastened to the head fixing member using a fastening member which is inserted in the through hole.

13. The head fixing member according to claim 11, further comprising:

a through hole, which passes through an inner portion of the first and second box beam sections and opens to a nozzle side of the plurality of liquid ejecting heads, wherein an intermediate member which is interposed between each of the plurality of liquid ejecting heads and the head fixing member is attached in each of the plurality of liquid ejecting heads, and the intermediate member is fastened to the head fixing member by a fastening member which is inserted in the through hole.

14. The head fixing member according to claim 11, further comprising:

a base section with a plate shape which is provided with the opening, wherein each of the first and second box beam sections are configured from a first wall section which has a side surface which faces the opening and is erected in the base section, a second wall section which is positioned further to the outside than the first wall section and is erected in the base section so as to oppose the first wall section, and a third wall section which is erected in the base section so as to connect the first wall section and the second wall section.

* * * * *